US006846560B2

(12) United States Patent
Koyanagi et al.

(10) Patent No.: US 6,846,560 B2
(45) Date of Patent: Jan. 25, 2005

(54) CONJUGATE FIBER AND METHOD OF PRODUCING SAME

(75) Inventors: Tadashi Koyanagi, Nobeoka (JP); Akira Yamashita, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/428,800

(22) Filed: May 5, 2003

(65) Prior Publication Data

US 2004/0048064 A1 Mar. 11, 2004

(30) Foreign Application Priority Data

May 27, 2002 (JP) ..... 2002-152700
Jul. 31, 2002 (JP) ..... 2002-223810

(51) Int. Cl.[7] ..... D01F 8/00; D02G 3/00

(52) U.S. Cl. ..... 428/370; 428/373; 428/374; 428/395

(58) Field of Search ..... 428/370, 373, 428/374, 395

(56) References Cited

U.S. PATENT DOCUMENTS

| | | | | |
|---|---|---|---|---|
| 3,671,379 | A | 6/1972 | Evans et al. | 161/173 |
| 6,306,499 | B1 | 10/2001 | Ochi et al. | 428/364 |
| 6,555,220 | B1 | 4/2003 | Koyanagi et al. | 428/373 |
| 6,673,443 | B2 * | 1/2004 | Koyanagi et al. | 428/364 |
| 2002/0025433 | A1 | 2/2002 | Chang et al. | 428/370 |

FOREIGN PATENT DOCUMENTS

| | | |
|---|---|---|
| EP | 1 059 372 A2 | 12/2000 |
| GB | 965729 | 8/1964 |
| JP | 8-337916 | 12/1996 |
| JP | 9-87922 | 3/1997 |
| JP | 11-189923 | 7/1999 |
| JP | 2000-239927 | 5/2000 |
| JP | 2000-0256918 | 9/2000 |
| JP | 2001-040537 | 2/2001 |
| JP | 2001064828 A | 3/2001 |
| JP | 2001-288620 | 10/2001 |
| JP | 2001-348734 | 12/2001 |
| JP | 2001355131 A | 12/2001 |
| JP | 2002-054029 | 2/2002 |
| JP | 2002061030 A | 2/2002 |
| JP | 2002-061031 | 2/2002 |
| JP | 2002-327341 | 11/2002 |
| JP | 2003-055846 | 2/2003 |
| WO | WO 01/53573 A1 | 7/2001 |
| WO | WO 02/086211 A1 | 10/2002 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

A poly(trimethylene terephthalate)-based conjugate fiber characterized in that the fiber is composed of single filaments which are combined with two polyester components in a side-by-side manner or an eccentric sheath-core manner, that at least one of the two polyester components forming the single filaments is a poly(trimethylene terephthalate), and that the fiber satisfies the following conditions:

(1) the stretch elongation of crimp manifested prior to boiling water treatment is 20% or less;

(2) the breaking elongation is from 25 to 100%; and (3) the maximum stress value of a dry heat shrinkage stress is from 0.01 to 0.24 cN/dtex.

14 Claims, 4 Drawing Sheets

CONJUGATE FIBER AND METHOD OF PRODUCING SAME

TECHNICAL FIELDS

The present invention relates to a poly(trimethylene terephthalate)-based conjugate fiber, obtained by a direct spin-draw process, which is excellent in dyeing uniformity and ease in dyeing and is suited to high speed false twisting, and a method of industrially and stably producing the same.

BACKGROUND ART

Knitted or woven fabrics, and stretched knitted or woven fabrics to which stretchability is imparted in particular, have been strongly desired in recent years in view of the wear comfort.

In order to satisfy such a desire, many knitted or woven fabrics to which stretchability is imparted by, for example, mingling a polyurethane-based fiber, have been developed.

However, the polyurethane-based fiber has the problems that because the fiber is hardly dyed with a dyestuffs employed for polyester, the dyeing process becomes complicated, and that the fiber is embrittled and the properties are deteriorated when used for a long period of time.

In order to avoid such drawbacks, application of the crimp yarn of a polyester-based fiber in place of a polyurethane-based fiber has been examined.

Many latent crimp fibers that are prepared by combining two types polymers in a side-by-side manner or eccentrically and that manifest crimp after heat treatment have been proposed. In particular, by utilizing the elongation recovery of a poly(trimethylene terephthalate) (hereinafter abbreviated to PTT), a latent crimp fiber has been prepared.

Prior literature on PTT-based latent crimp fibers includes, for example, Japanese Examined Patent Publication (Kokoku) No. 43-19108, Japanese Unexamined Patent Publication (Kokai) No. 2000-239927, Japanese Unexamined Patent Publication (Kokai) No. 2000-256918, Japanese Unexamined Patent Publication (Kokai) No. 2001-55634, Japanese Unexamined Patent Publication (Kokai) No. 2001-131837, European Patent (EP) No. 1059372, U.S. Pat. No. 6306499, Japanese Unexamined Patent Publication (Kokai) No. 2001-40537, Japanese Unexamined Patent Publication (Kokai) No. 2002-61031, Japanese Unexamined Patent Publication (Kokai) No. 2002-54029 and the like.

The prior literature discloses a side-by-side type two-component-based conjugate fiber and an eccentric sheath-core type conjugate fiber (both types being referred to as a PTT-based conjugate fiber) in which PTT is used for at least one component or two PTTs differing from each other in intrinsic viscosity are used for the two respective components. A soft feel and crimp manifestation properties are characteristic of the PTT-based conjugate fiber. Such prior art literature describes that the PTT-based conjugate fiber can be applied to various stretch knitted or woven fabrics or bulky knitted or woven fabrics by utilizing the excellent stretchability and elongation recovery of the fiber.

A PTT-based conjugate fiber is produced by a two-stage method wherein spinning and drawing are conducted in two stages, or a one-stage method wherein spinning and drawing are continuously conducted in one stage.

The one-stage method wherein spinning and drawing are continuously conducted is commonly called a direct spin-draw process, and is disclosed in Japanese Unexamined Patent Publication (Kokai) No. 2001-131837, Japanese Unexamined Patent Publication (Kokai) No. 2001-348734, Japanese Unexamined Patent Publication (Kokai) No. 2002-61031 and the like. The direct spin-draw process has the advantage that a PTT-based conjugate fiber can be produced at low cost in comparison with the two-stage method wherein spinning and drawing are conducted in two stages.

Production methods (direct spin-draw processes) of conjugate fibers for which PTT is not used are known in Japanese Unexamined Patent Publication (Kokai) No. 8-337916, Japanese Unexamined Patent Publication (Kokai) No. 9-87922, Japanese Unexamined Patent Publication (Kokai) No. 2001-288620 and the like. Such literature discloses methods of producing a highly crimpable conjugate fiber by stretching the fiber between the second and the third godet roll in the production of a poly(ethylene terephthalate)-based conjugate fiber (hereinafter poly (ethylene terephthatate) is referred to as PET).

However, a PET-based conjugate fiber obtained by a direct spin-draw process is not suited to blending with a natural fiber such as wool due to its low dye-affinity in comparison with a PTT-based conjugate fiber, and has the drawback that its applications are limited due to its significantly weak stretchability.

On the other hand, although the direct spin-draw process can produce a PTT-based conjugate fiber at low cost, it has become evident that the process has problems, as explained below, that are associated with the production and the fiber produced and that are caused by PTT.

[Problems During Production of PTT-Based Conjugate Fiber]

(I) Winding Stability

It is described in Japanese Unexamined Patent Publication (Kokai) No. 2001-131837 that the thermal shrinkage stress of the drawn yarn of a PTT-based conjugate fiber produced by a direct spin-draw process is preferably made high for the purpose of enhancing crimp manifestation. Moreover, it is described in the patent publication that, when the thermal shrinkage stress value of a PTT-based conjugate fiber is made 0.25 cN/dtex or more, the fiber has a crimp ratio of 10% or more even under a load of $3.5\times10^{-3}$ cN/dtex. Specifically, in Example 11 of the patent publication, a PTT-based conjugate fiber having a thermal shrinkage stress of 0.30 cN/dtex is described. Moreover, it is also described that when the conjugate fiber is used for a woven fabric that has a hard twist or that has a large texture restraint force, the woven fabric manifests high crimpability.

However, production of a PTT-based conjugate fiber showing a thermal shrinkage stress value as high as 0.25 cN/dtex or more encounters difficulties in spinning and winding. In particular, when a PTT-based conjugate fiber showing a high thermal shrinkage stress is wound into a package by a direct spin-draw process, problems as explained below arise.

When the thermal shrinkage stress of a PTT-based conjugate fiber is increased in order to improve the crimpability, the elastic recovery of the fiber becomes high, which is a phenomenon specific to a PTT. As a result, the PTT-based conjugate fiber shrinks to produce a poor package form during winding, or to cause package tightening, so that the package can hardly be taken out of the winding machine. Furthermore, a PTT-based conjugate fiber having a high thermal shrinkage stress tends to show irregular winding (also termed a wound yarn edge drop) on the sides of the package during winding, and yarn breakage is likely to take place during unwinding the conjugate fiber from the package. Still furthermore, because the conjugate fiber is wound with a high winding tension, the problem that a lowering in the success ratio of automated change-over of the package occurs. Accordingly, industrial production of a PTT-based conjugate fiber showing a high thermal shrinkage stress value has heretofore been extremely difficult.

(II) Dyeing Quality

In order to solve such problems, regarding winding a PTT-based conjugate fiber, as mentioned above, Japanese Unexamined Patent Publication (Kokai) No. 2001-348734 discloses a method comprising providing a non-heating relaxation roll between a second hot roll and a winding machine, and relaxing the fiber. However, as a result of attempting to practice the method, the present inventors have found that the non-heating relaxation roll temperature is influenced by a heat transferred by the fiber heated by the second hot roll, and consequently the relaxation roll temperature rises to about 40 to 50° C.

Because the temperature agrees with the glass transition temperature of a PTT, it has become clear that a slight variation of the temperature greatly influences the winding tension and the quality of the PTT-based conjugate fiber. Because industrial production of the fiber with multi-spindles is essential, the above variation causes a variation in the dyeing level of the fiber among spindles. As a result, the problem that a lowering in the dyeing uniformity occurs.

[Problems During Post-Treatment]

(III) High Speed False Twisting Property

Although a PTT-based conjugate fiber obtained by a direct spin-draw process can be used for knitted or woven fabrics without further processing, a false-twisted yarn prepared therefrom can manifest high stretchability even in high density woven fabrics showing a high restraining force as fabrics (see WO 02/086211).

Even in false twisting a PTT-based conjugate fiber, a high processing speed is required in order to improve the productivity. When an attempt is made to false twist at high speed either a known PTT-based conjugate fiber, the PTT-based conjugate fiber disclosed in Japanese Unexamined Patent Publication (Kokai) No. 2001-131837 and showing a high thermal shrinkage stress, or the bulky PTT-based conjugate fiber disclosed in Japanese Unexamined Patent Publication (Kokai) No. 2002-61031, crimp manifested in the PTT-based conjugate fiber hinders false twisting, and contact resistance, to guides of the false twisting machine, increases. As a result, it has become evident that fluctuation of a false twisting tension causes yarn breakage or produces uneven dyeing in the false-twisted yarn.

(IV) Tail End Transfer

Because false twisting is continuously conducted, the package is usually changed over by tail end transfer. A PTT-based conjugate fiber showing a high thermal shrinkage stress such as disclosed in Japanese Unexamined Patent Publication (Kokai) No. 2001-131837 generally exhibits a rise (manifestation starting) of a thermal shrinkage stress at temperature as low as about 50° C.; therefore, the tail end transfer becomes very difficult. Specifically, the PTT-based conjugate fiber peeled off the package for yarn tying rapidly manifests crimp at room temperature, and a yarn—yarn knotting operation is hard to conduct. Moreover, it has become clear that because knotting is difficult, the yarn—yarn knot strength tends to become weak, and as a result, yarn breakage frequently occurs during tail end transfer.

Such problems arising during false twisting become serious ones that make the industrial production difficult when high speed false twisting is conducted at a speed of about 400 m/min or more.

(V) Stretchability

A false-twisted yarn is required to manifest not only bulkiness but also high stretchability. A false-twisted yarn of a conjugate fiber composed of a PET as one component and a copolymerized PET as the other component is described in prior literature "Manual of Technologies of Processing Filaments" (Edited by The Textile Machinery Society of Japan: p190, 1976). According to the prior literature, the stretchability of the false-twisted yarn obtained by false twisting a conjugate fiber of PET/copolymerized PET is merely equal to the stretchability of a false-twisted yarn which is made from only PET or only copolymerized PET. In fact, PET-based conjugate fibers, described in Japanese Unexamined Patent Publication (Kokai) No. 8-337916, Japanese Unexamined Patent Publication (Kokai) No. 9-87922 and Japanese Unexamined Patent Publication (Kokai) No. 2001-288620, show no improvement of stretchability even when subjected to false twisting.

It has recently been proposed in Japanese Unexamined Patent Publication (Kokai) No. 2002-327341 and Japanese Unexamined Patent Publication (Kokai) No. 2003-55846 to draw and false twist highly oriented undrawn yarns of PTT-based conjugate fibers. However, the present inventors have found after investigation that, because such a highly oriented undrawn yarn has a breaking elongation as high as from 100 to 250%, the thermal shrinkages between the two components become close to each other by drawing and false twisting in a high ratio, and a false-twisted yarn showing high stretchability and adaptable to high density woven fabrics (the false-twisted yarn being an object of the present invention) cannot be obtained.

Therefore, creation of a PTT-based conjugate fiber excellent in dyeing uniformity and ease of dyeing and suited to high speed false twisting, and a method of stably producing the fiber by a direct spin-draw process is strongly desired.

DISCLOSURE OF THE INVENTION

An object of the present invention is to provide a PTT-based conjugate fiber obtained by a direct spin-draw process, excellent in dyeing uniformity and ease of dyeing and suited to high speed false twisting, and a method of industrially stably producing the fiber.

Furthermore, another object of the present invention is to provide a PTT-based conjugate fiber from which a false-twisted yarn excellent in high stretchability, dyeing quality and ease of dyeing can be prepared by false twisting, and a method of stably producing the fiber.

As a result of intensively carrying out investigations to achieve the above objects, the present inventors have achieved the present invention.

That is, the present invention is as explained below.

1. A conjugate fiber characterized in that the fiber is composed of single filaments which are combined with two polyester components in a side-by-side manner or an eccentric sheath-core manner, that at least one of the two polyester components forming the single filaments is a PTT, and that the fiber satisfies the following conditions (1) to (3):

(1) the stretch elongation of crimp manifested prior to boiling water treatment is 20% or less;

(2) the breaking elongation is from 25 to 100%; and (3) the maximum stress value of a dry heat shrinkage stress is from 0.01 to 0.24 cN/dtex.

2. A PTT-based conjugate fiber characterized in that the fiber is composed of single filaments which are combined with two polyester components in a side-by-side manner or an eccentric sheath-core manner, that at least one of the two polyester components forming the single filaments is a PTT, and that the fiber satisfies the following conditions:

(1) the stretch elongation of crimp manifested prior to boiling water treatment is 20% or less;

(2) the breaking elongation is from 25 to 55%;

(3) the maximum stress value of a dry heat shrinkage stress is from 0.01 to 0.24 cN/dtex; and (4) the stretch elongation after boiling water treatment under a load of $3.5\times10^{-3}$ cN/dtex ($CE_{3.5}$) is from 2 to 50%.

3. The PTT-based conjugate fiber according to 1 or 2, wherein the starting temperature of manifestation of a dry heat shrinkage stress is from 50 to 80° C.

4. The PTT-based conjugate fiber according to any one of 1 or 3, wherein the breaking elongation is from 45 to 100%.

5. The PTT-based conjugate fiber according to any one of 1 to 4, wherein the stretch elongation of crimp manifested prior to the boiling water treatment is 10% or less.

6. The PTT-based conjugate fiber according to any one of 1 to 5, wherein the stretch elongation after boiling water treatment under a load of $3.5\times10^{-3}$ cN/dtex ($CE_{3.5}$) is from 12 to 30%.

7. The PTT-based conjugate fiber according to any one of 1 to 6, wherein the maximum stress value of a dry heat shrinkage stress of the conjugate fiber is from 0.05 to 0.24 cN/dtex, and the breaking elongation is from 30 to 55%.

8. The PTT-based conjugate fiber according to any one of 1 to 6, wherein the maximum stress value of a dry heat shrinkage stress of the conjugate fiber is from 0.02 to 0.15 cN/dtex.

9. The PTT-based conjugate fiber according to any one of 1 to 8, wherein the stress value at 10% elongation in the elongation-stress measurement shows a difference between a maximum value and a minimum value along the yarn length direction of 0.30 cN/dtex or less.

10. The PTT-based conjugate fiber according to any one of 1 to 9, wherein the number of interlacing is from 2 to 50/m.

11. The PTT-based conjugate fiber according to any one of 1 to 10, wherein the two components forming the single filaments are both PTT.

12. The PTT-based conjugate fiber according to any one of 1 to 10, wherein the other one of the two components forming the single filaments is a poly(butylene terephthalate) or a PET.

13. The PTT-based conjugate fiber according to any one of 1 to 10, wherein the other one of the two components forming the single filaments is a PTT or a poly(butylene terephthalate), and the maximum temperature $T_{max}$ of a loss tangent obtained by the dynamic viscoelasticity measurement is from 80 to 98° C.

14. The PTT-based conjugate fiber according to any one of 1 to 10, wherein the other one of the two components forming the single filaments is a PET, and the half-value width of the maximum temperature $T_{max}$ of a loss tangent obtained by the dynamic viscoelasticity measurement is from 25 to 50° C.

15. The PTT-based conjugate fiber according to any one of 1 to 14, wherein the fiber is produced by a direct spin-draw process, and the fiber is wound in a package shape.

16. A method of producing a PTT-based conjugate fiber, wherein the fiber is composed of single filaments which are conjugated with two polyester components in a side-by-side manner or an eccentric sheath-core manner, the method comprising, during production of the conjugate fiber in which the at least one of the two components forming the single filaments is a PTT by a direct spin-draw process, cooling and solidifying the spun filaments, drawing and heat treating the yarn with at least three heating rolls without winding once, and satisfying the following conditions (A) to (C):

(A) the two polyester components differing from each other in intrinsic viscosity in an amount of from 0.05 to 0.9 dl/g are melt spun at a spinning speed of from 1,500 to 3,000 m/min;

(B) the melt spun filaments are cooled and solidified, and the resultant yarn is drawn, and heat treated; and (C) the yarn is wound at a winding speed of 4,000 m/min or less.

17. The method of producing a PTT-based conjugate fiber according to 16, wherein the two polyester components are joined together, and the joined polyester components are spun with a spinneret having a ratio of an injection nozzle length to a nozzle diameter of 2 or more, and an injection nozzle inclination making an angle of from 10 to 60 degrees with the vertical direction.

18. The method of producing a PTT-based conjugate fiber according to 16 or 17, wherein the injected conjugate fiber is cooled and solidified, and the single filaments are converged at a position from 0.5 to 1.5 m away from the spinneret.

19. The method of producing a PTT-based conjugate fiber according to 16 to 18, wherein an interlacer is provided before or after the first heating roll along the fiber line.

20. The method of producing a PTT-based conjugate fiber according to any one of 16 to 19, wherein the fiber tension at the inlet of the first heating roll is set at from 0.01 to 0.30 cN/dtex.

21. The method of producing a PTT-based conjugate fiber according to any one of 16 to 20, wherein the draw ratio between the first and the second heating roll is from 1 to 2.

22. The method of producing a PTT-based conjugate fiber according to any one of 16 to 21, wherein the yarn is heat treated between the second and the third heating roll with a tension set at from 0.02 to 0.5 cN/dtex.

23. The method of producing a PTT-based conjugate fiber according to any one of 16 to 22, wherein the relaxation ratio between the second and the third heating roll is from +10 to −10%.

24. The method of producing a PTT-based conjugate fiber according to any one of 16 to 23, wherein the roll temperature of the third heating roll is from 50 to 200° C.

25. The method of producing a PTT-based conjugate fiber according to any one of 16 to 24, wherein the roll temperature of the third heating roll is from 90 to 200° C.

26. The method of producing a PTT-based conjugate fiber according to any one of 16 to 25, wherein the winding speed is from 2,000 to 3,800 m/min.

The present invention will be explained below in detail.

The PTT-based conjugate fiber of the present invention is a conjugate fiber composed of single filaments that are combined with two polyester components in a side-by-side manner or an eccentric sheath-core manner. At least one of the components forming the single filaments is a PTT. That is, the single filaments are combined with a PTT and another polyester, or a PTT and another PTT.

In the present invention, the PTT that is at least one of the components is PTT homopolymer or copolymerized PTT containing preferably 10 mol % or less of the other ester repeating units.

Examples of the other copolymerization components include the compounds mentioned below.

Examples of the acid component include aromatic dicarboxylic acids represented by isophthalic acid and 5-sodiumsulfoisophthalic acid and aliphatic dicarboxylic acids represented by adipic acid and itaconic acid and the like. Examples of the glycol component include ethylene glycol, butylene glycol and polyethylene glycol and the like. Moreover, hydroxycarboxylic acids such as hydroxybenzoic acid are also included. A plurality of these compounds may also be copolymerized.

The other of the polyester components of single filaments forming the PTT-based conjugate fiber is, for example, a PET, a poly(butylene terephthalate) (hereinafter referred to as PBT) in addition to PTT, or a copolymerized polyester prepared by copolymerizing these polyesters with a third component.

Examples of the third component include the following compounds.

Examples of the acid component include aromatic dicarboxylic acids represented by isophthalic acid and 5-sodiumsulfoisophthalic acid and aliphatic dicarboxylic acids represented by adipic acid and itaconic acid and the like. Examples of the glycol component include ethylene glycol, butylene glycol and polyethylene glycol and the like. Moreover, hydroxycarboxylic acids such as hydroxybenzoic acid are also included. A plurality of these compounds may also be copolymerized.

In the present invention, the average intrinsic viscosity of a PTT-based conjugate fiber is preferably from 0.7 to 1.2 dl/g, more preferably from 0.8 to 1.2 dl/g.

When the intrinsic viscosity is in the above range, the conjugate fiber thus obtained has a sufficient strength, and a fabric having a high mechanical strength is obtained. The conjugate fiber can therefore be used for sportswear applications and the like requiring a high strength. Moreover, in the production stage of the conjugate fiber, stabilized production may be conducted without yarn breakage.

Known methods can be applied to the production of a PTT polymer to be used in the present invention. Examples of the production method include: a one-stage method comprising melt polymerizing alone so that the polymer has a polymerization degree corresponding to a predetermined intrinsic viscosity; and a two-stage method comprising melt polymerizing so that the polymer has an increased polymerization degree corresponding to a predetermined intrinsic viscosity, and subsequently solid state polymerizing so that the polymer has an increased polymerization degree corresponding to a predetermined intrinsic viscosity. Use of the latter two-stage method in which solid state polymerization is employed in combination is preferred for the purpose of decreasing the content of a cyclic dimer. When the one-stage method is employed to make the polymer have a polymerization degree corresponding to a predetermined intrinsic viscosity, a cyclic dimer is preferably decreased prior to supplying the polymer to the spinning step by treatment such as extraction.

Because an excessive content of a cyclic dimer exerts unfavorable effects on the fiber obtained, a PTT polymer used in the present invention has a trimethylene terephthalate cyclic dimer content of preferably 2.5 wt. % or less, more preferably 1.1 wt. % or less, and still more preferably 1.0 wt. % or less. A lower cyclic dimer content is preferred, and a cyclic dimer content of 0 is most preferred.

In the present invention, the two polyester components forming the single filaments are preferably both PTTs. When both components are PTTS, excellent stretching back properties can be manifested. Moreover, when both components are PTTS, it is desirable to use the two PTTs each having a trimethylene terephthalate cyclic dimer content of 2.5 wt. % or less for the purpose of decreasing a cyclic dimer content in the conjugate fiber.

Restriction of the content of a cyclic dimer contained in the conjugate fiber to 2.5 wt. % or less has the following advantages: precipitation of a cyclic dimer on guides of a heater outlet is avoided during false twisting; and yarn breakage is reduced during false twisting. The content of a cyclic dimer contained in the conjugate fiber is preferably 2.5 wt. % or less, more preferably 2.2 wt. % or less.

Furthermore, the intrinsic viscosity difference between the two components is from 0.05 to 0.9 dl/g, and the average intrinsic viscosity is still more preferably from 0.8 to 1.2 dl/g.

In the present invention, the combining ratio of the two polyesters differing from each other in intrinsic viscosity in a single filament cross section is as follows: the ratio of a high viscosity component to a low viscosity component is preferably from 40/60 to 70/30, more preferably from 45/55 to 65/35. When the ratio of a high viscosity component to a low viscosity component is in the above range, the yarn strength becomes 2.5 cN/dtex or more. As a result, a fabric having sufficient tear strength is obtained, and high crimpability is obtained.

In the present invention, for a conjugate fiber composed of single filaments that are each prepared by conjugating two polyester components in a side-by-side manner, the curvature r ($\mu$m) of a conjugated interface in a single filament cross section is preferably less than 10 $d^{0.5}$, more preferably from 4 to 9 $d^{0.5}$ wherein d is a size (dtex) of the single filament.

For the PTT-based conjugate fiber of the present invention, the stretch elongation of manifested crimp prior to boiling water treatment is 20% or less. When the stretch elongation thereof exceeds 20%, the fluctuation of tension becomes significant during false twisting due to the contact resistance of the guides of a false twisting machine. As a result, uneven dyeing of the fiber takes place, and yarn breakage and fluff formation occur during tail end transfer; therefore, industrially stabilized false twisting becomes difficult. A smaller manifested crimp makes the false twistability better. The stretch elongation of manifested crimp prior to boiling water treatment is preferably from 0 to 10%, more preferably from 1 to 5%.

When the PTT-based conjugate fiber of the present invention is used for warp knitting tricot or the like, the fiber has the advantage that no entanglement of a warp yarn takes place during warping because the manifested crimp is small and the fiber shows good warpability.

The PTT-based conjugate fiber of the present invention shows a breaking elongation of from 25 to 100%. When the breaking elongation is less than 25%, stabilized false twisting at an industrially necessary false twisting speed becomes difficult. When the breaking elongation exceeds 100%, uneven dyeing with a deep and with a pale color is likely to occur in the false-twisted yarn. Moreover, because the yarn is drawn by a factor of 1.8 or more during false twisting the yarn, the stretchability of the false-twisted yarn is lowered. The breaking elongation is preferably from 45 to 100%, more preferably from 45 to 80%, still more preferably from 50 to 80%.

When the PTT-based conjugate fiber of the present invention is to be used for a knitted or woven fabric without false twisting and further processing, the breaking elongation is preferably from 25 to 55%, more preferably from 30 to 55%. When the breaking elongation is less than 25%, yarn breakage is likely to take place during a direct spin-draw process, and stabilized spinning and drawing tend to become difficult. Further, when the breaking elongation exceeds 55%, the breaking strength becomes about 2 cN/dtex or less, and the applications are sometimes limited.

The PTT-based conjugate fiber of the present invention shows the maximum stress value of a dry heat shrinkage stress of from 0.01 to 0.24 cN/dtex, preferably from 0.03 to 0.20 cN/dtex, and more preferably from 0.05 to 0.15 cN/dtex. When the maximum stress value exceeds 0.24 cN/dtex, the PTT-based conjugate fiber wound in a package shrinks with the lapse of time to produce package tightening. As a result, the package is hard to take out of the winding machine. Moreover, a wound yarn edge drop is produced on the side surfaces of the package during winding to cause fluctuation of an unwinding tension during false twisting. As a result, the formation of uneven dyeing and yarn breakage take place, and stabilized false twisting of the yarn becomes difficult. When the maximum stress value is less than 0.01 cN/dtex, stabilized winding becomes difficult during the production of the PTT-based conjugate fiber.

The starting temperature of manifestation of a dry heat shrinkage stress of the PTT-based conjugate fiber in the invention is preferably from 50 to 80° C., more preferably from 55 to 75° C. As shown in FIG. 1, a baseline (iii) is drawn on the measurement chart of a dry heat shrinkage stress, and the starting temperature of manifestation of a dry heat shrinkage stress is a temperature at which the dry heat shrinkage stress curve departs from the baseline. In FIG. 1, a dry heat shrinkage stress curve (i) is an example of the PTT-based conjugate fiber of the present invention, and a dry heat shrinkage stress curve (ii) is one example of a conventional fiber. When the starting temperature of manifestation of a dry heat shrinkage stress is from 50 to 80° C., the tail portion of the yarn does not shrink substantially during false twisting. As a result, the yarn tying becomes easy, and the success ratio of tail end transfer becomes high. Moreover, because the PTT-based conjugate fiber suitably shrinks in the post-treatment stage such as scouring and dyeing, the surface of the woven fabric for which the PTT-based conjugate fiber is used is not opened, and the surface quality becomes good.

The maximum temperature of a dry heat shrinkage stress of the PTT-based conjugate fiber in the present invention is preferably 140° C. or more, more preferably from 150 to 200° C. The maximum temperature of a dry heat shrinkage stress designates a temperature at which the stress value becomes maximum in the dry heat shrinkage stress chart shown in FIG. 1. When the maximum temperature of a dry heat shrinkage stress is 140° C. or more, yarn breakage decreases during false twisting.

For the PTT-based conjugate fiber of the present invention, the stress value at 10% elongation in the elongation-stress measurement of the conjugate fiber shows a difference between a maximum value and a minimum value along the yarn length direction (hereinafter referred to as a stress value difference at 10% elongation) of preferably 0.30 cN/dtex or less, more preferably 0.20 cN/dtex or less. The stress value at 10% elongation in the elongation-stress measurement differs depending on fine structures of the fiber such as an orientation degree and a crystallinity degree thereof. The present inventors have made the following discovery: the variation of a stress value at 10% elongation well corresponds to the dyeing quality of the woven fabric; as a result, the dyeing uniformity of the fabric is more excellent when the variation of a stress in the yarn direction is smaller. When the stress value difference at 10% elongation is 0.30 cN/dtex or less, the dyeing quality of the woven fabric becomes good.

The PTT-based conjugate fiber of the present invention preferably shows a stretch elongation measured after boiling water treatment under a load of $3.5\times10^{-3}$ cN/dtex ($CE_{3.5}$) of from 2 to 50%. When the stretch elongation ($CE_{3.5}$) is in the above range, a common woven fabric prepared therefrom shows a large stretch ratio, and forms no creases with striped crepe-like effect on the fabric surface. The woven fabric has therefore a high commodity value. Moreover, when the conjugate fiber of the invention is used for a stretch woven fabric, the stretch elongation ($CE_{3.5}$) is preferably from 5 to 50%, more preferably from 12 to 30%.

The PTT-based conjugate fiber of the present invention preferably has a number of interlacings of from 2 to 50/m. When the PTT-based conjugate fiber of the present invention is supplied to false twisting, it is preferred to make the number of interlacings small because defects such as non-untwisting are not formed in the false-twisted yarn. In the above case, the number of interlacings is preferably from 2 to 10/m.

When the PTT-based conjugate fiber is supplied to the production of woven or knitted fabrics without further processing, the number of interlacings is preferably from 5 to 50/m, more preferably from 10 to 40/m.

In the present invention, the other component forming the single filaments is preferably a PTT or a PBT. Both components forming the single filaments are preferred to be PTTs in view of obtaining ease of dyeing of the fiber. When both components are PTTs, the maximum temperature of a loss tangent $T_{max}$ obtained by dynamic viscoelasticity measurement is preferably from 80 to 98° C. The maximum temperature of a loss tangent $T_{max}$ obtained thereby designates the temperature at which the loss tangent shows a peak in the chart of viscoelasticity measurement as shown in FIG. 2. That the peak temperature is low means that the fiber can be dyed at low temperature and has ease of dyeing. That a known PET fiber has a maximum temperature $T_{max}$ of about 130° C. supports good dyeing-affinity of the PTT-based conjugate fiber of the invention.

When the other component forming the single filaments is a PET, the half-value width t (° C.) of a loss tangent obtained by dynamic viscoelastic measurement is preferably from 25 to 50° C., more preferably from 25 to 40° C. The half-width value thereof is obtained by the following procedure: a vertical line is drawn at the maximum temperature $T_{max}$ in FIG. 2; and the half-value width thereof is a temperature width t (° C.) on the low temperature side at a ½ height [(½)h] from the intersection of the vertical line h and the base line L. A larger half-value width means that the absorbed amount of a dye is greater.

When the size fluctuation value U % of the PTT-based conjugate fiber of invention is measured along the yarn over a length of 2,000 m, the size fluctuation coefficient (CV value) of periodic unevenness along a yarn length of from 20 to 60 m is preferably 0.5 or less, more preferably 0.4 or less. The periodic unevenness along a length of from 20 to 60 m is a periodic unevenness of a size fluctuation characteristically generated when a PTT having an intrinsic viscosity of 0.8 or more is used as one component of the conjugate fiber. The periodic size unevenness causes generation of band-like uneven dyeing defects when the PTT-based conjugate fiber is used as a weft yarn of a woven fabric without twisting. When the conjugate fiber has a smaller size fluctuation coefficient (CV value), the resultant woven fabric has better quality.

The PTT-based conjugate fiber of the present invention is wound preferably in a package shape. Because the unwinding tension fluctuation during unwinding the PTT-based conjugate fiber from the package is small during high speed false twisting when the conjugate fiber is wound in a package shape, the package shape is preferred. The winding weight of the package is usually from 0.5 to 20 kg, preferably from 1 to 10 kg.

Furthermore, because the PTT-based conjugate fiber of the invention wound in a package has no drawback such as a wound yarn edge drop of the package, the fiber shows excellent unwindability.

Although there is no specific limitation on the size or single filament size of the PTT-based conjugate fiber in the present invention, the multifilaments size is preferably from 20 to 300 dtex, and the single filament size is preferably from 0.5 to 20 dtex. The size of a monofilament is preferably from 50 to 2,000 dtex. Of course, the PTT-based conjugate fiber of the invention may be cut, and used as a short fiber. For example, the conjugate fiber may be cut into a length of from 5 to 200 mm, and used as a staple. Because the PTT-based conjugate fiber of the invention has small manifested crimp, the staple shows good carding processability, which is characteristic of the present invention.

Furthermore, there is no specific limitation on the cross-sectional shape of the filament, and the filament may have a modified cross section such as a round-shaped, a Y-shaped and a W-shaped cross section, a hollow cross section, and the like.

The PTT-based conjugate fiber in the present invention may be made to contain, as long as the effects of the present invention are not marred, additives such as delustering agents (such as titanium oxide), thermal stabilizers, antioxidants, antistatic agents, ultraviolet ray absorbers, antibacterial agents and various pigments. The conjugate fiber may also be made to contain such additives by copolymerization. Either the PTT component or the other polyester component, or both components may be made to contain additives such as delustering agents.

Next, the production method of the invention will be explained.

The present invention is characterized in that a conjugate fiber wherein the fiber is composed of single filaments that are combined with two polyester components in a side-by-side manner or an eccentric sheath-core manner, and at least one component forming the single filaments is a PTT, is produced by a direct spin-draw process.

It is important in the production method of the present invention that after cooling and solidifying, the yarn be drawn and heat treated with at least three heating rolls without winding. The stretch elongation of crimp manifested prior to boiling water treatment can be made 20% or less by conducting drawing and heat treatment with at least three heating rolls. In particular, as will be described later, it is important to control the manifested crimp by strictly selecting the heat treatment tension between the second and the third heating roll, and the third heating roll temperature.

In the production method of the present invention, two polyester components having an intrinsic viscosity difference of from 0.05 to 0.9 are melt spun. When the intrinsic viscosity difference is less than 0.05, the false-twisted yarn thus obtained shows no sufficient stretchability. Moreover, the stretch elongation measured after boiling water treatment under a load of $3.5\times10^{-3}$ cN/dtex ($CE_{3.5}$) becomes less than 2%. On the other hand, when the intrinsic viscosity exceeds 0.9 dl/g, the following disadvantages result. Even when the design of the spinning nozzle and the injection conditions are altered, the problems of yarn bending during injection and contamination of the injection nozzle are not adequately overcome, and the periodic unevenness of the fiber size fluctuation value U % of the PTT-based conjugate fiber becomes large; the uniformity of dyeing is impaired. A preferred intrinsic viscosity difference is from 0.1 to 0.6 dl/g. When both components are PTTs, the intrinsic viscosity difference is preferably from 0.1 to 0.4.

In the production method of the invention, the yarn is spun at a spinning speed of from 1,500 to 3,000 m/min, and the spun yarn is heat treated after drawing. When the spinning speed is less than 1,500 m/min, uneven dyeing with a deep and with a pale color is formed in the PTT-based conjugate fiber and the false-twisted yarn subsequently obtained. When the spinning speed exceeds 3,000 m/min, the PTT-based conjugate fiber after drawing shows a breaking strength of about 2 cN/dtex or less, and application of the fiber to sportswear and the like required to have a strength is restricted. Moreover, the stretch elongation measured after boiling water treatment under a load of $3.5\times10^{-3}$ cN/tex ($CE_{3.5}$) becomes less than 2%. A preferred spinning speed is from 1,600 to 2,500 m/min.

It is important in the production method of the present invention to draw and heat treat a spun conjugate fiber with at least 3 heating rolls, and wind at a winding speed of 4,000 m/min or less. When the winding speed exceeds 4,000 m/min, wound yarn edge drop defects are formed in the package, and stabilized winding becomes difficult due to the shrinkage of the package with the lapse of time after winding; moreover, a tension fluctuation occurs during false twisting due to package tightening, and the dyeing uniformity of the false-twisted yarn is impaired. Furthermore, the orientation degree of the conjugate fiber is increased, and the maximum stress value of a dry heat shrinkage stress exceeds 0.24 cN/dtex. The winding speed is preferably from 2,000 to 3,800 m/min, more preferably from 2,200 to 3,400 m/min.

When the conjugate fiber is wound, not industrially but experimentally, with a package winding weight of less than 0.5 kg, the above problems during winding are, naturally, sometimes not manifested. In such winding, a winding speed of from 4,000 to 7,000 m/min may also be adopted.

In the production method of the present invention, a known conjugate spinning apparatus with a double-screw extruder can be employed except for using a spinneret shown in FIG. 3.

FIG. 3 is a schematic view of a spinneret appropriate to the production method of the present invention. In FIG. 3, (a) and (b) designate a distribution plate and a spinning nozzle, respectively. Two polyester components A, B are fed to the spinning nozzle (b) through the distribution plate (a).

Both polyester components are joined together at the spinning nozzle (b), and injected through an injection nozzle having an inclination making an angle of θ degrees with the vertical direction. The nozzle diameter and nozzle length of the injection nozzle are designated by D and L, respectively.

In the present invention, the ratio of an injection nozzle length L to an injection nozzle diameter D (L/D) is preferably 2 or more. When the L/D ratio is 2 or more, fluctuation caused by the melt viscosity difference of the polyesters during injection from the injection nozzle after joining the two polyesters differing from each other in composition or intrinsic viscosity does not occur. As a result, a conjugate fiber showing a stabilized conjugated state of both components and dyeing uniformity is obtained. Although a larger ratio of the injection nozzle length to the injection nozzle diameter is preferred, the ratio is preferably from 2 to 8, more preferably from 2.5 to 5, in view of the easiness of the preparation of the injection nozzle.

The injection nozzle of the spinneret used in the present invention preferably has an inclination making an angle θ of from 10 to 60° with the vertical direction. The inclination angle of the injection nozzle with respect to the vertical direction designates an angle θ (degrees) in FIG. 3. That the injection nozzle has an inclination making an angle with the vertical direction is an important requirement for solving the problem of filament bending caused by a melt viscosity difference during injecting two polyesters differing from each other in composition or intrinsic viscosity. When the injection nozzle has no inclination, stabilized spinning becomes difficult due to a so-called bending phenomenon wherein use of, for example, a combination of two PTTs having a larger intrinsic viscosity difference between the two makes the filament immediately after injection bend more in a higher intrinsic viscosity direction.

In FIG. 3, the following procedure is preferred. A PTT polymer having a higher viscosity is supplied to the A side, and another polyester or PTT polymer having a lower intrinsic viscosity is supplied to the B side, followed by injecting both polymers. For example, when the PTT polymers differ from each other in intrinsic viscosity in an amount of about 0.1 or more, the injection nozzle is preferably made to have an inclination that makes an angle of 10° or more with the vertical direction in order to solve the problem of bending and realize stabilized spinning. When the intrinsic viscosity difference is still larger, the inclination angle is preferably made larger. However, when the inclination angle exceeds 60°, the injected portion becomes elliptical, and stabilized spinning becomes difficult. Moreover, preparation of the nozzle itself tends to become difficult. The inclination angle is preferably from 15 to 45°, more preferably from 20 to 35°.

In the present invention, the above inclination angle range in combination with the ratio of an injection nozzle length to an injection nozzle diameter of 2 or more produces the effects more effectively. Stabilized effects of injection can always be obtained by adjusting the inclination angle in the above range.

FIG. 4 shows a schematic view of one embodiment of a conjugate spinning apparatus used in the production method of the present invention.

First, PTT pellets of one component are dried with a drying machine 1 to have a moisture content of 20 ppm or less, fed to an extruder 2 set at temperature of from 250 to 280° C., and melted. The other component is similarly dried with a drying machine 3, fed to an extruder 4, and melted. The molten two components are transferred to a spin head 7 set at temperature of from 250 to 285° C. through respective bends 5, 6, and separately metered with gear pumps. The two types of components are subsequently joined together in a spinneret 9 mounted on a spin pack 8 and having a plurality of nozzles, combined in a side-by-side manner, and extruded into a spinning chamber as multifilaments 10. The optimum temperatures of the extruder and spin head are selected from the above ranges while the intrinsic viscosity and shape of both components (PTT pellets and the like) are taken into consideration.

The PTT multifilaments 10 extruded into the spinning chamber are passed through a non-air blowing region 11 that is 50 to 300 mm long, and then cooled to room temperature with cooling air 12 to be solidified. A finishing agent is applied to the solidified filaments with a finishing agent applicator 13. The multifilaments are then taken up with a take-up godet roll (also functioning as a drawing roll) 14 (first heating roll in FIG. 4) rotating at a predetermined speed, then continuously drawn without winding between the first heating roll and a second heating roll 15, stretched and heat treated with a third heating roll 16, and wound as a conjugate fiber package 17 having a predetermined yarn size with a winding machine.

An aqueous emulsion type finishing agent is preferably used as the above finishing agent. The concentration of the aqueous emulsion is preferably 10 wt. % or more, more preferably from 15 to 30 wt. %.

Providing a finishing agent applicator 13 (also acting as a filament converging apparatus) 0.5 to 1.5 m below the spinneret, and converging the multifilaments are preferred in order to decrease the tension at the inlet of the first heating roll 14.

The tension at the inlet of the first heating roll 14 is preferably from 0.01 to 0.30 cN/dtex. When the tension thereat is in the above range, stabilized drawing may be conducted, and the PTT-based conjugate fiber may be uniformly dyed.

In the production method of the invention, it is preferred to provide an interlacer 18 before or after the first heating roll 14 along the fiber line and interlace the yarn. A known interlacing nozzle is adopted as the interlacer 18. The air pressure during imparting interlacing is preferably from 0.05 to 0.9 MPa. When the air pressure is in the above range, the number of interlacing of the conjugate fiber is from 2 to 50/m, and the unwindability of the conjugate fiber from the package becomes good. In addition, use of an air pressure exceeding 0.9 MPa can also increase the number of interlacing.

In the production method of the invention, at least three heating rolls are employed. For example, in FIG. 4, a pair of pretension rolls may also be provided before the first heating roll 14.

In the present invention, the yarn is preferably drawn between the first heating roll 14 and the second heating roll 15. The yarn is drawn by making the peripheral speed of the first heating roll differ from that of the second heating roll 15. The draw ratio is preferably from 1 to 2, more preferably from 1.2 to 2. When the draw ratio is in the above range, the PTT-based conjugate fiber thus obtained has good dyeing qualities.

The drawing stress is preferably from 0.1 to 0.5 cN/dtex, more preferably from 0.3 to 0.5 cN/dtex. The drawing stress is a tension per unit size (dtex) of a yarn between the first heating roll 14 and the second heating roll 15, and is adjusted by selecting the temperature of the first heating roll 14 and the draw ratio. When the drawing stress is in the above range, the strength of the PTT-based conjugate fiber becomes about 2 cN/dtex or more, and woven fabrics having a sufficient mechanical strength can be obtained. Moreover, the breaking elongation becomes 25% or more, and the PTT-based conjugate fiber can be stably produced. Furthermore, the maximum stress value of a dry heat shrinkage stress becomes 0.24 cN/dtex or less.

During drawing, it is preferred to heat the first heating roll preferably to a temperature of 50° C. or more and 90° C. or less, more preferably 55° C. or more and 70° C. or less.

The drawn conjugate fiber is subjected to necessary heat treatment at the second heating roll 15 and the third heating roll 16. The temperature of the second heating roll 15 is preferably from 80 to 160° C., more preferably from 100 to 140° C.

The tension during the heat treatment between the second heating roll 15 and the third heating roll 16 is preferably from 0.02 to 0.5 cN/dtex, more preferably from 0.12 to 0.44 cN/dtex, still more preferably from 0.12 to 0.35 cN/dtex. When the heat treatment tension is in the above range, the thermal shrinkage stress value becomes 0.24 cN/dtex or less. As a result, the following advantages can be obtained: the yarn can be stably wound to form a package; good false twistability is obtained; and the stretch elongation ($CE_{3.5}$) becomes 2% or more, and adequate stretchability is obtained.

In the production method of the invention, the relaxation ratio of the yarn between the second heating roll 15 and the third heating roll 16 is preferably from +10 to −10%, more preferably from +2 to −10%, still more preferably from 0 to −6%. In addition, the relaxation ratio (%) is defined by the following formula:

relaxation ratio (%)={[(peripheral speed of the second heating roll)−(peripheral speed of the third heating roll)]/(peripheral speed of the second heating roll)}×100

When the relaxation ratio is in the above range, the following advantages can be obtained: the stress applied to the conjugate fiber between the second heating roll 15 and the third heating roll 16 never exceeds a breaking strength, and no yarn breakage takes place, which enables industrially stabilized production of the conjugate fiber; and the stretch elongation measured after boiling water treatment under a load of $3.5\times10^{-3}$ cN/dtex becomes 2% or more, and woven fabrics having sufficient stretchability are obtained.

In the production method of the present invention, the temperature of the third heating roll 16 is preferably from 50 to 200° C., more preferably from 90 to 200° C., still more preferably from 120 to 160° C. When the temperature of the third heating roll 16 is 50° C. or more, the effects of heat set, namely, relaxation treatment on the third heating roll 16 become adequate, and the following advantages are obtained: the dry heat shrinkage stress value of the conjugate fiber becomes 0.24 cN/dtex or less, and package tightening is not produced; moreover, the starting temperature of manifestation of a dry heat shrinkage stress becomes 50° C. or more, good false twistability is obtained, and the conjugate fiber shows substantially no uneven dyeing. When the temperature of the third heating roll is 200° C. or less, the starting temperature of manifestation of a dry heat shrinkage stress of the conjugate fiber becomes 80° C. or less, and knitted or woven fabrics showing good stretchability are obtained. In addition, when the third heating roll temperature is too high, yarn breakage caused by local melting of the conjugate fiber on the roll due to the PTT melting point of about 230° C. takes place, and industrially stabilized production of the conjugate fiber becomes difficult. When the roll temperature is 200° C. or less, no yarn breakage takes place, and the conjugate fiber can be industrially and stably produced.

In the production method of the present invention, the effect of heating the PTT-based conjugate fiber at the temperature mentioned above with the third heating roll 16 is insurance of the package quality, namely, solving the problem of "a wound yarn edge drop", and improvement of the success ratio of change-over during package winding. During winding a PTT-based conjugate fiber, a tension fluctuation corresponding to a traverse angle occurs to a large degree, and the tension fluctuation sometimes causes "a wound yarn edge drop" on the package sides. A package with "a wound yarn edge drop" causes an extraordinary unwinding tension during unwinding the PTT-based conjugate fiber from the package, and yarn breakage takes place during high speed false twisting of the yarn.

The cycle of a tension fluctuation during winding can be easily obtained from the following formula:

$$\text{tension fluctuation cycle (Hz)}=(v/60\times\tan\theta)/H$$

wherein H is a traverse stroke (m) of the winding machine, v is a winding speed (m/min), and θ is a traverse angle (degrees).

For example, when H, v and θ are 0.085 (m), 3,000 (m/min) and 7.0 (degrees), respectively, the tension fluctuation cycle becomes 72 (Hz).

The present inventors have confirmed that the relaxation behavior of a conjugate fiber against a stress from the outside can be estimated from measurements of the dynamic viscoelasticity. That is, the loss tangent can be obtained by making dynamic viscoelasticity measurements at a frequency approximately equal to the tension fluctuation cycle. The present inventors have found that when the conjugate fiber is heated between the final roll and the winding machine at temperature near the peak temperature of the loss tangent, the tension fluctuation amplitude is decreased and, consequently, the "wound yarn edge drop" of the package is also decreased. Although the phenomenon is also observed in other synthetic fibers, the effect of suppressing the wound yarn edge drop is more significantly manifested in the PTT-based conjugate fiber of the invention because the winding tension is made preferably as low as from 0.02 to 0.1 cN/dtex in order to suppress the package tightening.

Furthermore, the following has also been found: when the conjugate fiber is heated to temperature near or above the peak temperature of the above loss tangent, the tension fluctuation amplitude is decreased; at the same time, heating also has the effect of improving the success ratio of change-over during package winding because the tension fluctuation is also relaxed at the instant of change-over of the package winding, namely, at the instant at which the fiber to be wound is changed over from a fully wound package to a new bobbin. For example, the peak temperature of the loss tangent of the conjugate fiber having a PTT/PTT weight ratio of 50/50 is about 90° C. Accordingly, the effect of solving the problem of "a wound yarn edge drop" and the success ratio of change-over are decreased when the PTT-based conjugate fiber is heated with the third heating roll at temperature of less than 50° C.

In the present invention, the surface roughness of each heating roll is preferably from a mirror surface to an 8 S (satin finish). In particular, the first heating roll preferably has a mirror surface or one with roughness of 0.8 S or less. The surface roughness of the second and third heating rolls is preferably from 0.8 to 8 S (satin finish) rather than a mirror surface in view of solving the problems of yarn breakage and "a wound yarn edge drop" during winding and improving the success ratio of change-over.

Furthermore, each heating roll may be optionally a tapered roll in which the diameter gradually increases or decreases from the inlet to the outlet of the roll. In particular, when the first heating roll is a tapered one in which the diameter gradually increases, the roll shows a significant effect of improving the dyeing uniformity of the PTT-based conjugate fiber.

In the production method of the invention, it is preferred to conduct winding while the traverse angle is varied from 3 to 10°, more preferably from 4 to 9° in accordance with the winding diameter during the period from starting to finishing winding the yarn, in order to make the unwindability of the PTT-based conjugate fiber from the package good. The traverse angle can be set by adjusting the winding speed and the traverse speed. When the traverse angle is in the above range, normal winding can be conducted without collapsed winding; moreover, formation of the high edge of the package can be suppressed by controlling the dry heat shrinkage stress of the drawn yarn and the cooling during winding.

In the present invention, the traverse angle of the intermediate layer is preferably made larger than that of the inner layer. The inner layer of a package herein designates a wound portion having a winding thickness from the bobbin of about 10 mm or less. A preferred example of the traverse angle that is varied in accordance with a winding diameter is as follows: the traverse angle is made low at the start of winding, namely, in the inner layer of the package; the traverse angle is gradually increased as the winding diameter is increased, and made highest in the intermediate layer of the package; and the traverse angle is made low again in the outer layer. As explained above, both the bulging and high edge of the package can be adequately reduced by conducting winding while the traverse angle is varied in accordance with the winding diameter.

There is no specific limitation on the false twisting method for obtaining a false-twisted yarn using the PTT-based false-twisted fiber of the present invention. For example, any of the false twisting methods such as a pin type, a friction type, a nip belt type and an air false twisting type false twisting method may be used as a false twisting one. The heating heater may be either a contact type or a noncontact type.

The twist factor K1 of a false twist number (T1) that is calculated from the formula shown below is preferably from 21,000 to 33,000, more preferably from 25,000 to 32,000. When the twist factor K1 of a false twist number is in the above range, a textured yarn having excellent crimpability and stretchability is obtained, and yarn breakage in the false twisting step hardly occurs.

$$T1\ (T/m)=K1/\{\text{size (dtex) of the raw yarn}\}^{1/2}$$

Knitted or woven fabrics having good quality without defects such as streaky defects and tight yarn, and a soft feel are obtained by using a false-twisted yarn prepared by false twisting a PTT-conjugate fiber obtained according to the present invention. Moreover, because the false-twisted yarn has a property of showing significant crimp manifestation even when heat treated under a load, the yarn is appropriate to woven fabrics with high restraining force.

A PTT-based false-twisted yarn obtained by false twisting the PTT-based conjugate fiber of the invention has an elongation recovery rate as large as from 20 to 40 m/sec that is measured after boiling water treatment and that is comparable to the elongation recovery rate of a spandex fiber of from 30 to 50 m/sec. The false-twisted yarn having such a property can provide knitted or woven fabrics having excellent stretchability and quick stretch recovery, namely, excellent adaptability to the body movement when clothing is prepared therefrom.

Because the wear pressure during wearing a woven fabric for which a PTT-based false-twisted yarn obtained by the present invention is used is small, the wearer hardly gets tired even when the wearer wears it for a long period. Moreover, because the woven fabric is excellent in adaptability to the body movement, the woven fabric characteristically hardly forms the wrinkles ordinarily formed in a portion of the reverse side of the knee and a hip portion when used for pants (trousers), skirts and the like. The woven fabric is therefore extremely suited to pants, skirts, uniforms and the like.

When the false-twisted yarn is used for a knitted fabric, the yarn can be applied to many knitted fabrics represented by warp- or weft-knitted fabrics. Specifically, the yarn is extremely suitable to jerseys, swimwear, stockings and the like. That these products have adaptability to the body movement in wear comfort comparable to a spandex fiber is a principal characteristic of the yarn.

When a false-twisted yarn prepared from the PTT-based conjugate fiber of the invention is used for knitted or woven fabrics, the yarn may be used without twisting, or it may be interlaced or twisted in order to enhance the convergence.

When the yarn is to be twisted, the yarn is preferably twisted in the direction equal to or reverse to the false twisting direction. In this case, the twist factor is preferably made 5,000 or less. The twist factor k is expressed by the formula:

$$\text{twist number } T(\text{times}/m)=k/[\text{size (dtex) of the false-twisted yarn}]^{1/2}$$

A false-twisted yarn prepared from the PTT-based conjugate fiber of the present invention may be used singly. Alternatively, even when the yarn is combined with another fiber in combination and used, the effects of the present invention can be achieved. When the yarn is to be combined, the yarn may be used as a filaments yarn without further processing, or it may be used as short fibers. Examples of the other fibers to be combined include other polyester fibers, chemical synthetic fibers such as nylon fibers, acrylic fibers, cuprammonium fibers, rayon fibers, acetate fibers and polyurethane elastic fibers, and natural fibers such as cotton, hemp, silk and wool. However, the examples are not restricted to the above fibers. Moreover, the other fibers to be combined may be filaments yarns or short fibers.

Furthermore, in order to form a mingling composed yarn by mingling composing the false-twisted yarn and another fiber, various mingling methods can be employed. Examples of the methods include the following: the false-twisted yarn and another fiber are subjected to interlace mingling; the yarn and another fiber are subjected to interlace mingling, and the resultant yarn is drawn and false twisted; the yarn or another fiber is false twisted, and both are subjected to interlace mingling; the yarn and another fiber are separately false twisted, and both are subjected to interlace mingling; the yarn or another fiber is Taslan textured, and both are subjected to interlace mingling; the yarn and another fiber are subjected to interlace mingling, and the resultant yarn is Taslan textured; and the yarn and another fiber are subjected to Taslan mingling. The mingling composed yarn obtained by such a method as mentioned above is preferably interlaced in an amount of 10/m or more, more preferably from 15 to 50/m.

The PTT-based conjugate fiber of the present invention may be used for knitted or woven fabrics without false twisting and without further processing. In this case, the PTT-based conjugate fiber of the invention may be used singly. Alternatively, the fiber and another fiber may be mingling composed and used. The advantage of using the fiber for knitted or woven fabrics without false twisting is that excellent dyeing qualities, in the knitted or woven fabrics, can be obtained. Moreover, the conjugate fiber may also be knitted or woven to give fabrics, and knitted or woven fabrics having good quality without crepe effect and uneven dyeing can be obtained.

Examples of the texture of the woven fabrics may include a plain weave texture, a twill weave texture and a satin weave texture, and various modified textures derived from these textures. A false-twisted yarn of the PTT-based conjugate fiber of the present invention can be used as a warp yarn alone, a weft yarn alone or both warp and weft yarns of woven fabrics. These woven fabrics have a stretch ratio of 10% or more, preferably 20% or more, more preferably 25% or more. When the stretch ratio is 20% or more, clothing such as sportswear prepared therefrom can instantaneously adapt to a local and instantaneous motional displacement. The effects of the present invention can therefore be effectively achieved.

The recovery ratio of the woven fabrics is preferably from 80 to 100%, more preferably from 85 to 100%.

Furthermore, that the elongation stress, during elongating the woven fabrics, is small is also characteristic of the PTT-based conjugate fiber of the invention. For example, when the elongation stress at 20% elongation is 150 cN/cm or less, the wearer has a less tightened feeling during wearing, and the elongation stress is preferred. The elongation stress at 20% elongation is more preferably from 50 to 100 cN/cm.

BEST MODE FOR CARRYING OUT THE INVENTION

Figure 1:
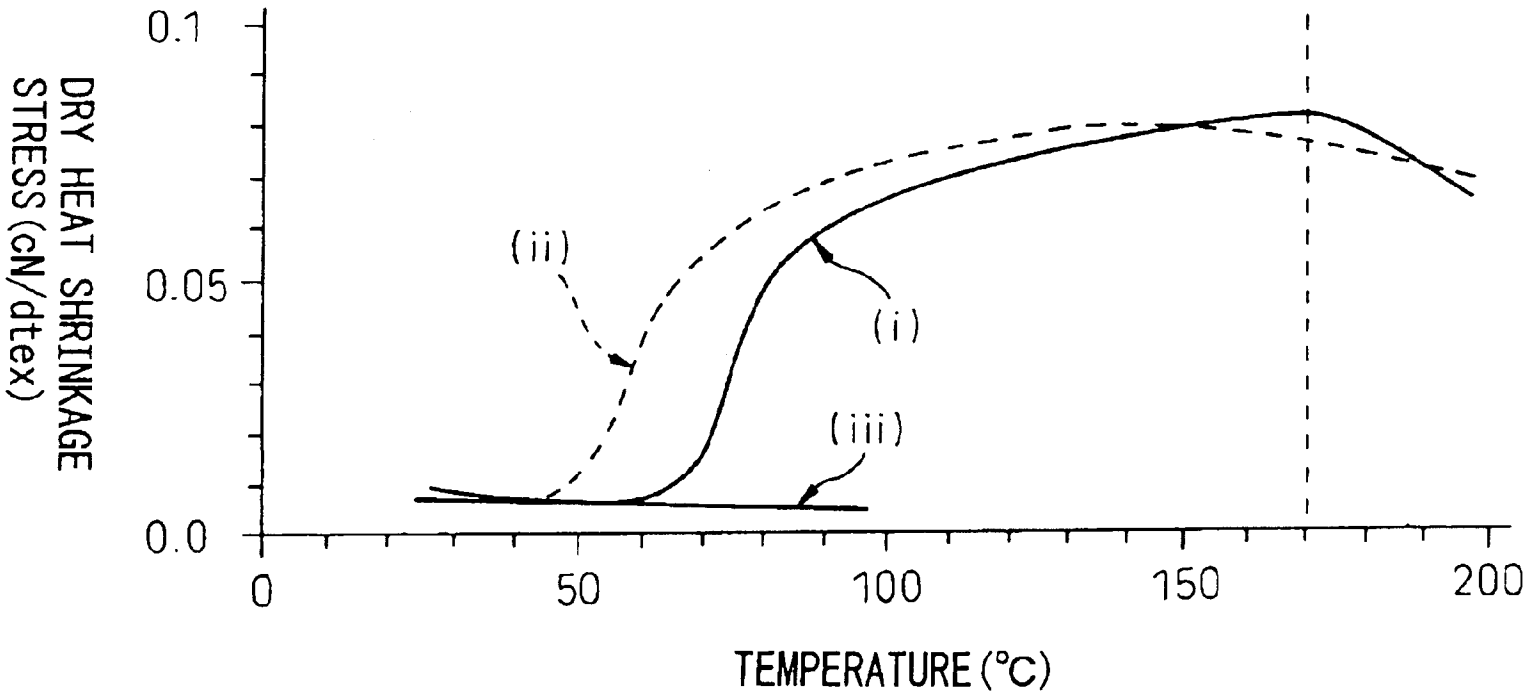
FIG. 1 is a schematic view showing one example of a dry heat shrinkage stress curve.
Figure 2:
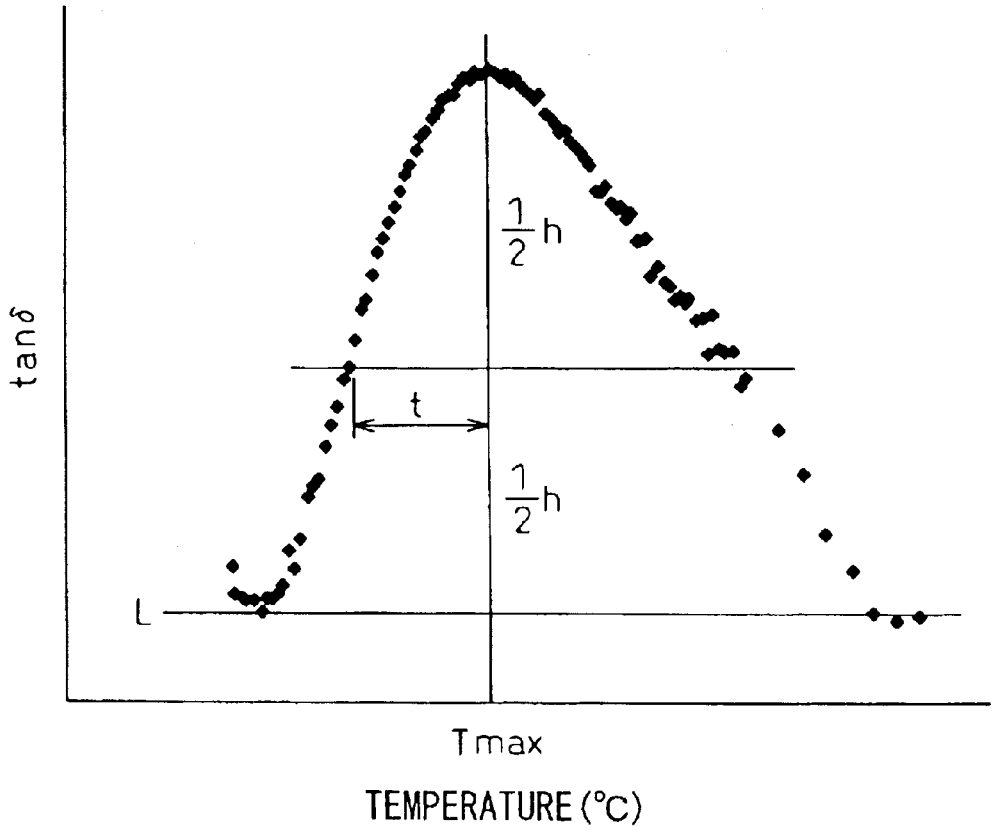
FIG. 2 is a schematic view showing one example of a curve of a loss tangent obtained by measuring a dynamic viscoelasticity.
Figure 3:
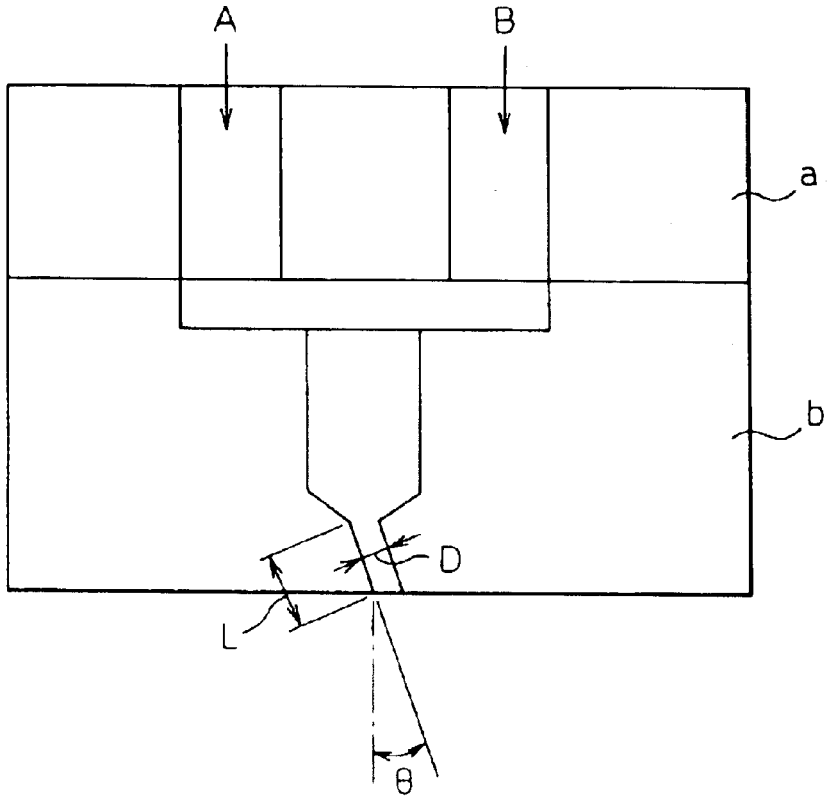
FIG. 3 is a schematic view showing one embodiment of a spinneret used during spinning a conjugate fiber of the present invention.

The present invention will be further explained in detail by making reference to examples.

In addition, measurement methods, evaluation methods, and the like are as described below.

(1) Intrinsic Viscosity

The intrinsic viscosity [η] is a value determined on the basis of a definition of the following formula:

$$[\eta]=\lim_{C\to 0}(\eta_r-1)/C$$

wherein $N_r$ is a value obtained by dividing the viscosity at 35° C. of a diluted solution of a PTT polymer that is prepared by dissolving the polymer in an o-chlorophenol solvent with a purity of 98% or more by the viscosity of the solvent that is measured at the same temperature and defined as a relative viscosity, and C is a polymer concentration in terms of g/100 ml.

(2) Stretch Elongation (Vc) of Manifested Crimp

A yarn is formed into a hank of 10 turns using a counter reel with a circumference of 1.125 m. The hank is left in a thermo-hygrostat specified by JIS L 1013 under no load for a whole day and night. The following loads are then applied to the hank, and the hank lengths are measured. The stretch elongation (Vc) of manifested crimp is obtained from the following formula:

stretch elongation (%)=[(L2−L1)/L1]×100 wherein L1 is a hank length under a load of $1\times10^{-3}$ cN/dtex, and L2 is a hank length under a load of 0.18 cN/dtex.

(3) Breaking Strength, Breaking Elongation, Difference between Stress Values at 10% Elongation Measurements are made in accordance with JIS L 1013.

The elongation-stress of a yarn is measured 100 times in the longitudinal direction of the yarn, and stresses at 10% elongation (cN) are measured. The maximum and minimum values of the measured values are read, and a value obtained by dividing the difference by the size (dtex) is defined as the difference between stress values at 10% elongation (cN/dtex).

(4) Maximum Stress Value of Dry Thermal Shrinkage Stress

Measurements are made with a thermal stress measurement apparatus (trade name of KE 2, manufactured by Kanebo ENGINEERING, LTD). A yarn is cut to give a yarn sample about 20 cm long. Both ends of the sample are tied to form a loop, which is mounted on the measurement apparatus. Measurements are made under the following conditions: an initial load of 0.05 cN/dtex; and a heating rate of 100° C./min. A chart of heat shrinkage stress vs. temperature is drawn during the measurements. The heat shrinkage stress draws a mountain type curve in the high temperature region. A value obtained from the read peak value (CN) using the following formula is defined as the maximum stress value:

maximum stress value={[read peak value (cN)]/[size (dtex)×2]}−initial load (cN/dtex)

(5) Stretch Elongation after Boiling Water Treatment ($CE_{3.5}$)

A yarn is formed into a hank of 10 turns using a counter reel with a circumference of 1.125 m. The hank thus obtained is subjected to boiling water treatment for 30 minutes while a load of $3.5\times10^{-3}$ cN/dtex is being applied. The hank is then dry heat treated at 180° C. for 15 minutes under the same load. The hank is then left in a thermo-hygrostat specified by JIS L 1013 for a whole day and night. The following loads are then applied to the hank, and the hank lengths are measured. The stretch elongation is obtained from the following formula:

stretch elongation (%) after boiling water treatment=[(*L*2−*L*1)/*L*1]×100 wherein L1 is a hank length under a load of $1\times10^{-3}$ cN/dtex, and L2 is a hank length under a load of 0.18 cN/dtex.

(6) Ease of Dyeing

The dye exhaustion rate is measured as an estimation of the ease of dyeing.

A PTT-based conjugate fiber or a false-twisted yarn of the fiber is knitted with one feeder. The knitted fabric is scoured at 70° C. for 20 minutes in a warm aqueous solution containing 2 g/l of Scourol 400 (trade name, manufactured by Kao-Atlas), and dried with a tumbler. The knitted fabric is then heat set at 180° C. for 30 sec with a pin tenter to give a sample for evaluation.

The knitted fabric is placed in a dyeing bath. The dyeing bath is then heated from 40 to 100° C., and held at the temperature for 1 hour; the dye exhaustion rate is then evaluated. Kayalon Polyester Blue 3RSF (manufactured by Nippon Kayaku Co., Ltd.) is used as a dye, and the knitted fabric is dyed (6% omf, bath ratio of 1:50). Nicca Sunsolt 7000 (trade name, manufactured by Nicca Chemical Co., Ltd.) is used as a dispersant in an amount of 0.5 g/l with the pH of the bath adjusted to 5 with 0.25 ml/l of acetic acid and 1 g/l of sodium acetate.

The dye exhaustion rate is obtained from the following formula:

dye exhaustion rate (%)=[(*A*−*a*)/*A*]×100 wherein A is an absorbance of the dye stock solution, and a is an absorbance of the dyeing solution after dyeing. In addition, the absorbance is obtained at a wavelength of 580 nm that is the maximum absorption one of the dye.

When the dye exhaustion rate is 80% or more in the measurement, the sample is judged to have good dyeing qualities.

(7) Stretch Elongation of False-Twisted Yarn Under Load of $3\times10^{-3}$ cN/dtex A false-twisted yarn is formed into a hank of 10 turns using a counter reel with a circumference of 1.125 m. The hank thus obtained is subjected to boiling water treatment for 30 minutes while a load of $3\times10^{-3}$ cN/dtex is being applied. The hank thus obtained is dry heat treated at 180° C. for 15 minutes under the same load. The hank is then left in a thermo-hygrostat specified by JIS L 1013 for a whole day and night. The following loads are then applied to the hank, and the hank lengths are measured. The stretch elongation is obtained from the following formula:

$$\text{stretch elongation (\%) under a load of } 3\times10^{-3} \text{ cN/dtex}=[(L4-L3)/L3]\times100$$

wherein L3 is a hank length under a load of $1\times10^{-3}$ cN/dtex, and L4 is a hank length under a load of 0.18 cN/dtex.

(8) Elongation Recovery Ratio of False-Twisted Yarn

A false-twisted yarn is formed into a hank of 10 turns using a counter reel with a circumference of 1.125 m. The hank thus obtained is subjected to boiling water treatment under no load for 30 minutes. The false-twisted yarn thus treated is left to stand under no load for a whole day and night to provide a sample. A measurement is made on the false-twisted yarn sample by a procedure explained below in accordance with JIS L 1013.

The false-twisted yarn sample is stretched to have a stress of 0.15 cN/dtex by a tensile tester, and pulling on the yarn sample is stopped. The yarn sample is maintained in the stretched state for 3 minutes and cut by scissors directly above a lower nip point. The speed of shrinkage of the false-twisted yarn cut by the scissors is obtained by making a film of the shrinkage with a high-speed video camera (resolution: 1/1000 sec). A mm-scale rule is fixed at a distance of 10 mm from the false-twisted yarn in a side-by-side manner, and the video camera is focused on a tip end of the cut false-twisted yarn so that a film of the recovery of the cut tip end is made. The film made by the high-speed video camera is played back so that the displacement per unit time (mm/msec) of the cut tip end of the false-twisted yarn is read. The recovery rate (m/sec) is determined from the read value.

(9) Spinning Stability

Using a melt spinning-continuous drawing machine on which 8-ends of spinning nozzle per spinneret are mounted, melt spinning-continuous drawing is conducted for two days in each example.

The spinning stability is judged from a number of yarn breakage taking place during the period, and a formation frequency of fluff (proportion of a number of fluff formation packages) present in the conjugate fiber packages thus obtained, according to the following criteria.

◎: No yarn breakage takes place, and the proportion of fluff formation packages is 5% or less.

○: Yarn breakage takes place twice or less, and the proportion of fluff formation packages is less than 10%.

X: Yarn breakage takes place three times or more, and the proportion of fluff formation packages is 10% or more.

(10) False Twisting Stability

False twisting is conducted under the following conditions.

False twisting apparatus: 33 H false twisting apparatus (manufactured by Murata Industry Co., Ltd.) with 96 spindles/machine used False twisting conditions: yarn speed of 500 m/min, number of false twisting of 3,230 T/m;

draw ratio being set so that the elongation of the textured yarn becomes about 40%;

first feed rate of −1%; and first heater temperature of 170° C.

The false twisting stability is judged in accordance with the following criteria:

◎: number of false-twisted yarn breakage being less than 10 times/day·machine;

○: number of false-twisted yarn breakage being from 20 to 10 times/day·machine; and X: number of false-twisted yarn breakage exceeding 20 times/day·machine.

(11) Dyeing Quality

A PTT-based conjugate fiber or a false-twisted yarn is knitted with one feeder, scoured, and dyed. The fabric thus obtained is inspected, and the dyeing quality is judged in accordance with the following criteria:

◎: extremely good with no defect such as uneven dyeing;

○: good with no defect such as uneven dyeing; and

X: no good with uneven dyeing.

(12) Stretch Ratio and Elongation Recovery Ratio of Woven Fabric

A fabric is prepared by the following procedure.

An untwisted sized yarn of a PTT fiber alone of 84 dtex/24 f (trade name of Solotex, manufactured by Asahi Kasei Corporation) is used as a warp yarn, and a PTT-based conjugate fiber or a false-twisted yarn obtained in each of the examples or comparative examples is used as a weft yarn; a plain weave fabric (warp density of 97 ends/2.54 cm, a weft density of 88 picks/2.54 cm) is prepared from the warp and weft yarns.

A water jet loom (trade name of ZW 303, manufactured by TSUDAKOMA Corp.) is used as a loom, and operated at a weaving speed of 450 rpm.

The gray fabric thus obtained is relaxed and scoured at 95° C. with an open soaper, and dyed at 120° C. with a jet dyeing machine. The dyed fabric is then subjected to a series of treatments at 170° C. of finishing, and tentering and heat setting. The woven fabric subsequent to finishing has a warp density of 160 ends/2.54 cm and a weft density of 93 picks/2.54 cm.

The fabric thus obtained is used, and the stretch ratio and elongation recovery ratio are evaluated by the following procedure.

Using a tensile testing machine manufactured by Shimadzu Corporation, a sample attached to the testing machine with a grip width of 2 cm and a grip-to-grip distance of 10 cm is elongated at a tensile rate of 10 cm/min in the weft direction. The elongation (%) under a stress of 2.94 N/cm is defined as the stretch ratio. The sample is then shrunk at the same rate until the grip-to-grip distance becomes 10 cm. A stress-strain curve is then drawn again.

The elongation recovery ratio (%) is obtained from the following formula:

$$\text{elongation recovery ratio (\%)}=[(10-A)/10]\times100$$

wherein A is a residual elongation that is an elongation when the stress is manifested.

(13) Overall Estimation

◎: Spinning stability, false twisting stability and textured yarn quality are extremely good.

○: Spinning stability, false twisting stability and textured yarn quality are good.

X: One of spinning stability, false twisting stability, or textured yarn quality is not good.

EXAMPLES 1 TO 4, COMPARATIVE EXAMPLE 1

The present examples relate to PTT-based conjugate fibers appropriate to high speed false twisting, and the effects of an intrinsic viscosity difference between two components.

Figure 4:
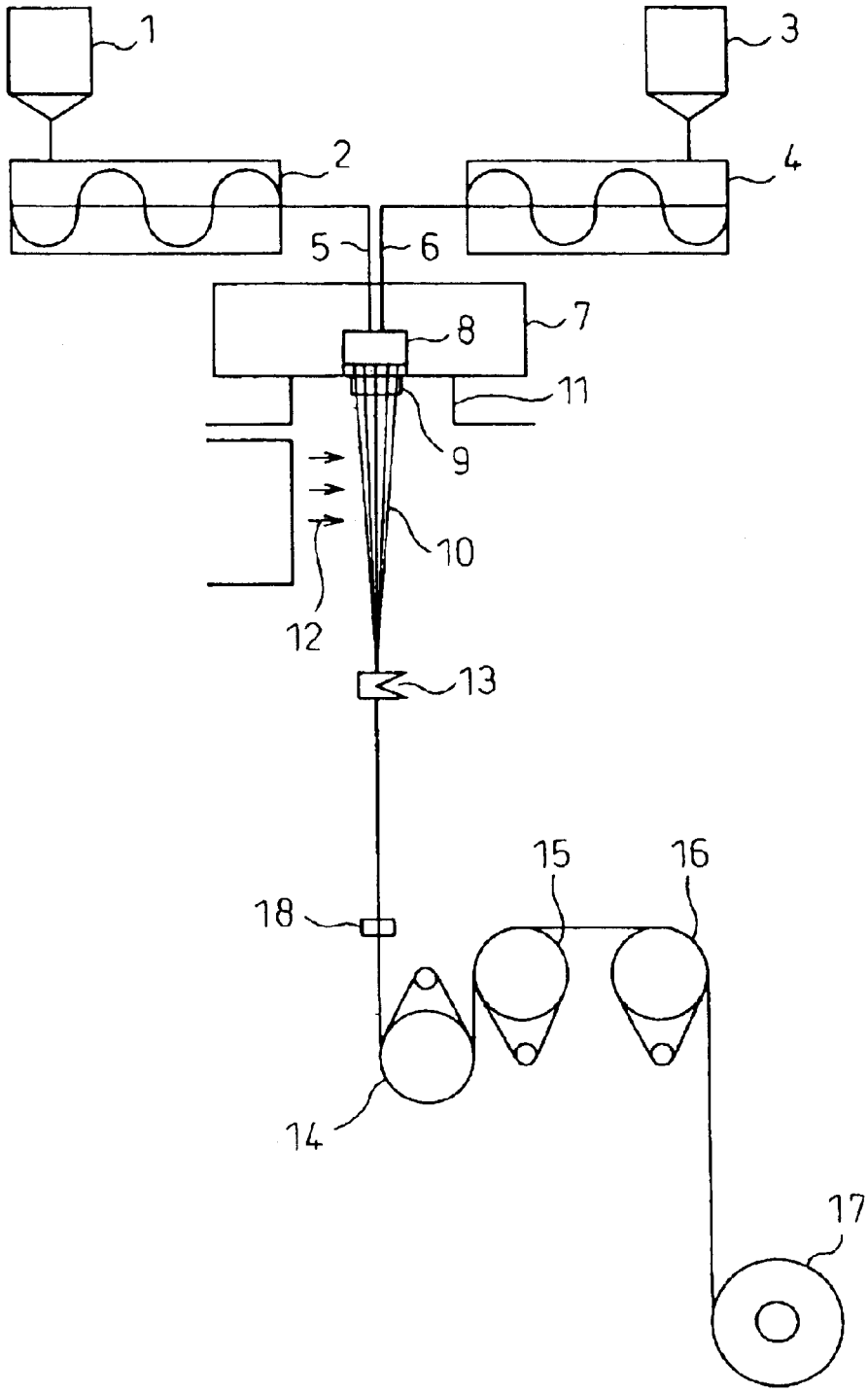
FIG. 4 is a schematic view showing one embodiment of a conjugate spinning apparatus for producing a conjugate fiber of the present invention.

As shown in Table 1, a PTT containing 0.4 wt. % of titanium oxide and 0.9 wt. % of a cyclic dimer and having a high intrinsic viscosity was used as one component, and a PTT containing 0.4 wt. % of titanium oxide and 1.8 wt. % of a cyclic dimer and having a low intrinsic viscosity was used as the other component. Both types of pellets were supplied to a conjugate spinning machine as shown in FIG. 4, and a package of a PTT-based conjugate fiber of 84 dtex/24 filaments having a winding weight of 6 kg was produced.

The spinning conditions are shown below.

(Spinning Conditions)

Pellet drying temperature and attained moisture content: 110° C., 15 ppm

Extruder temperature: 255° C. at the A axis, 250° C. at the B axis

Spin head temperature: 265° C.

Spinning nozzle diameter: 0.50 mm
nozzle length: 1.25 mm
L/D: 2.5
Inclination angle of nozzle: 35°

Conditions of cooling air: temperature of 22° C., relative humidity of 90%, blowing speed of 0.5 m/sec Non-air-blowing region: 225 mm Finishing agent: aqueous emulsion of a finishing agent (concentration of 10 wt. %) containing a polyether ester as a major component Distance from the spinneret to a nozzle for applying a finishing agent: 90 cm Spinning tension: 0.08 cN/dtex (Winding Conditions)

First heating roll: 55° C., speed of 2,000 m/min

Second heating roll: 120° C., speed being set so that the breaking elongation becomes 50%

Third heating roll: 60° C.

Winding machine: AW-909 (manufactured by Teijin Seiki Co., Ltd.)
both the bobbin shaft and the contact roll shaft being self-driving Relaxation ratio between the third heating roll and the winding machine: 0%

Winding speed: all winding being conducted at a speed of from 2,500 to 3,000 m/min Winding traverse angle: 4.4° at a winding thickness of from 0 to 5 mm
9.2° at a winding thickness of from 5 to 70 mm
6.4° at a winding thickness of from 70 to 110 mm Winding tension: 0.05 cN/dtex Package temperature during winding: 25° C.

Table 1 shows the results of the measurements and evaluation. It is evident from Table 1 that the textured yarn subsequent to false twisting shows good stretchability and stretch recovery as long as the intrinsic viscosity difference between the two components is within the range of the present invention.

EXAMPLES 5 TO 7, COMPARATIVE EXAMPLES 2 AND 3

The present examples relate to PTT conjugate fibers appropriate to false twisting, and the effects of breaking elongation and manifested crimp on the stretch elongation will be explained.

Conjugate fibers were produced with the combination of intrinsic viscosities shown in Example 2 while the ratio of a speed of the first heating roll to a speed of the second heating roll, namely, the draw ratio was varied as shown in Table 2.

Table 2 shows the physical properties of the conjugate fibers and false-twisted yarns thus obtained. It is evident from Table 2 that good spinning stability and false twisting stability are obtained as long as the breaking elongation and the stretch elongation of manifested crimp of each of the conjugate fibers are within the range of the present invention. In contrast, when the breaking elongation is outside the range of the present invention as shown in Comparative Examples 2 and 3, yarn breakage takes place during false twisting, and the industrial production of the conjugate fiber is difficult.

EXAMPLES 8 TO 11, COMPARATIVE EXAMPLE 4

The present examples relate to PTT conjugate fibers appropriate to knitted or woven fabrics without false twisting, and the effects of an intrinsic viscosity difference will be explained.

As shown in Table 3, a PTT containing 0.4 wt. % of titanium oxide and 0.9 wt. % of a cyclic dimer and having a high intrinsic viscosity was used as one component, and a PTT containing 0.4 wt. % of titanium oxide and 2.4 wt. % of a cyclic dimer and having a low intrinsic viscosity was used as the other component. Both types of pellets were supplied to a conjugate spinning machine as shown in FIG. 4, and a package of a PTT conjugate fiber of 56 dtex/24 filaments having a winding weight of 6 kg was produced. In addition, in Comparative Example 4, conjugate spinning was not done but spinning a single component was conducted.

The spinning conditions are shown below.

(Spinning Conditions)

Pellet drying temperature and attained moisture content: 110° C., 15 ppm

Extruder temperature: 250° C. at the A axis, 250° C. at the B axis

Spin head temperature: 265° C.

Spinning nozzle diameter: 0.50 mm
nozzle length: 1.25 mm
L/D: 2.5
inclination angle of nozzle: 35°

Conditions of cooling air: temperature of 22° C., relative humidity of 90%, blowing speed of 0.5 m/sec Non-air-blowing region: 125 mm Finishing agent: aqueous emulsion of a finishing agent (concentration of 10% by weight) containing 55 wt. % of an aliphatic acid ester, 10 wt. % of a polyether, 30 wt. % of a nonionic surfactant and 5 wt. % of an antistatic agent Distance from the spinneret to a nozzle for applying a finishing agent: 90 cm Spinning tension: 0.07 cN/dtex (Winding Conditions)

First heating roll: 55° C., speed of 2,500 m/min

Surface roughness: 0.2 S, mirror surface

Inlet-outlet taper ratio: 3%, gradually increasing

Second heating roll: 120° C., speed being set so that the breaking elongation becomes 40%

Third heating roll: 150° C.

Winding machine: AW-909 (manufactured by Teijin Seiki Co., Ltd.)

both the bobbin shaft and the contact roll shaft being self-driving

Winding speed: all winding conducted at a speed of from 2,500 to 3,000 m/min

Winding traverse angle: 4.4° at a winding thickness of from 0 to 5 mm 9.2° at a winding thickness of from 5 to 70 mm 6.4° at a winding thickness of from 70 to 110 mm Winding tension: 0.05 cN/dtex Package temperature during winding: 25° C.

Table 3 shows the results of measurements and evaluation. It is evident from Table 3 that each of the woven fabrics thus obtained shows good stretchability and stretch recovery as long as the intrinsic viscosity difference between the two components is within the range of the present invention.

EXAMPLES 12 TO 15, COMPARATIVE EXAMPLES 5 AND 6

The present examples relate to PTT-based conjugate fibers appropriate to knitted or woven fabrics without false twisting, and the effects of the breaking elongation, the stretch elongation of manifested crimp and the stretch elongation ($CE_{3.5}$) after boiling water treatment will be explained.

Conjugate fibers were produced with the combination of intrinsic viscosities shown in Example 9 while the ratio of a speed of the first heating roll to a speed of the second heating roll, namely, the draw ratio was varied as shown in Table 4.

Table 4 shows the physical properties of the conjugate fibers and woven fabrics thus obtained. It is evident from Table 4 that good spinning stability and woven fabric quality are obtained as long as the breaking elongation and the stretch elongation of manifested crimp, and the stretch elongation after boiling water treatment are within the ranges of the present invention.

In contrast, as shown in Comparative Example 5, when the breaking elongation is outside the range of the present invention, the yarn shows a low stretch elongation under load ($CE_{3.5}$), and poor stretchability. Moreover, as shown in Comparative example 6, when the breaking elongation of the yarn is outside the range of the present invention, yarn breakage takes place during spinning, and industrial production of the yarn is difficult.

EXAMPLES 16 TO 20, COMPARATIVE EXAMPLE 7

The present examples relate to PTT-based conjugate fibers that are appropriate to knitted or woven fabrics without false twisting, and the effects of dry heat shrinkage stress will be explained.

PTT-based conjugate fibers were produced in the same manner as in Example 9 except that the heat treatment tension between the second and the third heating roll, or the third heating roll temperature was varied as shown in Table 5.

Table 5 shows the physical properties of the conjugate fibers and woven fabrics thus obtained. It is clear from Table 5 that the good spinnability and woven fabric quality were obtained as long as the dry heat shrinkage stress and breaking elongation of the conjugate fibers are within the ranges of the present invention.

EXAMPLE 21 TO 23, COMPARATIVE EXAMPLE 8

In the present examples, the effects of types of polymers used in the production of conjugate fibers will be explained.

Conjugate fibers were obtained in the same manner as in Example 9 except that two types of polymers were used in combination as shown in Table 6.

Table 6 shows the physical properties of the conjugate fibers and woven fabrics thus obtained. It is evident from Table 6 that a conjugate fiber in which PTT is used as at least one component has good woven fabric quality, stretchability and stretch recovery. In contrast, in Comparative Example 8, because the conjugate fiber contains no PTT, the fiber has poor stretchability.

EXAMPLE 24 TO 26, COMPARATIVE EXAMPLES 9 AND 10

In the present examples, the effects of a spinning speed will be explained.

Conjugate fibers were prepared from two PTT yarns in combination that were used in Example 9 and that each had an intrinsic viscosity different from the other, while the speed of the first heating roll, namely, the spinning speed was varied as shown in the table.

Table 7 shows the physical properties of the conjugate fibers thus obtained. It is clear from Table 7 that the dyeing quality of the textured yarns is good as long as the spinning speed is within the range of the present invention. Because the spinning speed is outside the range of the present invention in Comparative Examples 9 and 10, the dyeing quality of the textured yarns is not good, and the spinning stability is poor.

TABLE 1

| | Comp. Ex. 1 | Ex. 1 | Ex. 2 | Ex. 3 | Ex. 4 |
|---|---|---|---|---|---|
| High viscosity component | | | | | |
| Type of polymer | PTT | PTT | PTT | PTT | PTT |
| [η] dl/g | 0.95 | 1.26 | 1.26 | 1.26 | 1.26 |
| Low viscosity component | | | | | |
| Type of polymer | PTT | PTT | PTT | PTT | PTT |
| [η] dl/g | 0.92 | 1.02 | 0.92 | 0.82 | 0.65 |

TABLE 1-continued

| | Comp. Ex. 1 | Ex. 1 | Ex. 2 | Ex. 3 | Ex. 4 |
|---|---|---|---|---|---|
| Viscosity difference dl/g | 0.03 | 0.24 | 0.34 | 0.44 | 0.61 |
| (Winding conditions) | | | | | |
| Spinning speed m/min | 2000 | 2000 | 2000 | 2000 | 2000 |
| Winding speed m/min | 2250 | 2580 | 2580 | 2580 | 2580 |
| Spinning stability | ◎ | ◎ | ◎ | ◎ | ○ |
| (Physical properties of conjugate fiber) | | | | | |
| Breaking strength cN/dtex | 2.8 | 2.7 | 2.1 | 2.4 | 2.1 |
| Breaking elongation % | 105 | 52 | 53 | 51 | 50 |
| Stress difference at 10% elongation cN/dtex | 0.40 | 0.25 | 0.23 | 0.24 | 0.26 |
| Maximum stress of dry heat shrinkage stress cN/dtex | 0.15 | 0.12 | 0.10 | 0.09 | 0.08 |
| Starting temperature of manifestation of dry heat shrinkage stress | 57 | 58 | 59 | 60 | 60 |
| Stretch elongation of manifested crimp Vc % | 0 | 7 | 8 | 9 | 16 |
| Stretch elongation after boiling water treatment $CE_{3.5}$% | 0 | 2 | 3 | 4 | 5 |
| Number of interlacing | 20 | 8 | 5 | 4 | 3 |
| $T_{max}$ of loss tangent ° C. | 103 | 92 | 92 | 92 | 92 |
| Half-value width of $T_{max}$ of loss tangent ° C. | 33 | 33 | 34 | 34 | 35 |
| Dye exhaustion rate % | 65 | 85 | 85 | 85 | 84 |
| Dyeing quality | ○ | ◎ | ◎ | ◎ | ◎ |
| Stretch ratio of fabric in the weft direction % | 4 | 11 | 12 | 13 | 15 |
| Stretch recovery of fabric | 60 | 82 | 89 | 91 | 91 |
| False twisting stability | ◎ | ◎ | ◎ | ◎ | ◎ |
| (Physical properties of false-twisted yarn) | | | | | |
| Stretch elongation under loading % | 13 | 61 | 89 | 94 | 104 |
| Elongation recovery rate m/sec | 14 | 20 | 28 | 29 | 31 |
| Dye exhaustion rate % | 65 | 81 | 85 | 82 | 83 |
| Dyeing quality | ◎ | ◎ | ◎ | ◎ | ○ |
| Stretch ratio of fabric in the weft direction % | 10 | 25 | 30 | 35 | 42 |
| Stretch recovery ratio of fabric % | 61 | 88 | 92 | 94 | 93 |
| Overall estimation | X | ◎ | ◎ | ◎ | ○ |

TABLE 2

| | C. Ex. 2 | Ex. 5 | Ex. 6 | Ex. 7 | C. Ex. 3 |
|---|---|---|---|---|---|
| High viscosity component | | | | | |
| Type of polymer | PTT | PTT | PTT | PTT | PTT |
| [η] dl/g | 1.26 | 1.26 | 1.26 | 1.26 | 1.26 |
| Low viscosity component | | | | | |
| Type of polymer | PTT | PTT | PTT | PTT | PTT |
| [η] dl/g | 0.92 | 0.922 | 0.92 | 0.92 | 0.92 |
| Viscosity difference dl/g | 0.34 | 0.34 | 0.34 | 0.34 | 0.34 |
| (Winding conditions) | | | | | |
| Spinning speed m/min | 2000 | 2000 | 2000 | 2000 | 2000 |
| Winding speed m/min | 2100 | 2260 | 2580 | 2900 | 4100 |
| Draw ratio | 1.01 | 1.13 | 1.31 | 1.50 | 2.13 |
| Relaxation ratio % | −5.0 | −1.3 | −0.4 | 0.0 | 0.0 |
| Spinning stability | ○ | ◎ | ◎ | ◎ | X |
| (Physical properties of conjugate fiber) | | | | | |
| Breaking strength cN/dtex | 1.5 | 1.6 | 1.8 | 2.0 | 3.5 |
| Breaking elongation % | 120 | 79 | 59 | 46 | 21 |
| Stress difference at 10% elongation cN/dtex | 0.33 | 0.25 | 0.18 | 0.25 | 0.41 |
| Maximum stress of dry heat shrinkage stress cN/dtex | 0.01 | 0.05 | 0.08 | 0.16 | 0.3 |
| Starting temperature of manifestation of dry heat shrinkage stress ° C. | — | 80 | 75 | 65 | 45 |
| Stretch elongation of manifested crimp Vc % | 0 | 2 | 3 | 9 | 28 |
| Stretch elongation after boiling water treatment $CE_{3.5}$% | 0 | 2 | 2 | 5 | 28 |
| Number of interlacing | 4 | 5 | 5 | 5 | 2 |
| $T_{max}$ of loss tangent ° C. | 89 | 90 | 91 | 92 | 100 |
| Half-value width of $T_{max}$ of loss tangent ° C. | 40 | 36 | 35 | 34 | 34 |
| Dye exhaustion rate % | 88 | 88 | 85 | 84 | 81 |
| Dyeing quality | ○ | ◎ | ◎ | ◎ | X |

TABLE 2-continued

| | C. Ex. 2 | Ex. 5 | Ex. 6 | Ex. 7 | C. Ex. 3 |
|---|---|---|---|---|---|
| Stretch ratio of fabric in the weft direction % | — | — | 4 | 11 | 30 |
| Stretch recovery of fabric | — | — | 80 | 83 | 90 |
| False twisting stability | X | ⊙ | ⊙ | ⊙ | X* |
| (Physical properties of false-twisted yarn) | | | | | |
| Stretch elongation under loading % | 66 | 67 | 82 | 85 | ** |
| Elongation recovery rate m/sec | 10 | 26 | 28 | 29 | |
| Dye exhaustion rate % | — | 84 | 85 | 85 | |
| Dyeing quality | — | ⊙ | ⊙ | ⊙ | |
| Stretch ratio of fabric in the weft direction % | — | 40 | 41 | 43 | |
| Stretch recovery ratio of fabric % | — | 90 | 91 | 90 | |
| Overall estimation | X | ⊙ | ⊙ | ⊙ | X |

Note: *Tail breakage

**Incapable of being sampled

TABLE 3

| | Comp. Ex. 4 | Ex. 8 | Ex. 9 | Ex. 10 | Ex. 11 |
|---|---|---|---|---|---|
| High viscosity component | | | | | |
| Type of polymer | PTT | PTT | PTT | PTT | PTT |
| [η] dl/g | 0.93 | 1.27 | 1.26 | 1.26 | 1.26 |
| Low viscosity component | | | | | |
| Type of polymer | — | PTT | PTT | PTT | PTT |
| [η] dl/g | — | 1.02 | 0.92 | 0.81 | 0.64 |
| Viscosity difference dl/g | — | 0.25 | 0.34 | 0.45 | 0.62 |
| (Winding conditions) | | | | | |
| Spinning speed m/min | 2000 | 2000 | 2000 | 2000 | 2000 |
| Winding speed m/min | 2870 | 2870 | 2870 | 2870 | 2870 |
| Draw ratio | 1.51 | 1.51 | 1.51 | 1.51 | 1.51 |
| Drawing stress cN/dtex | 0.35 | 0.35 | 0.35 | 0.35 | 0.35 |
| Heat treatment tension between 2GD–3GD CN/dtex | 0.35 | 0.35 | 0.35 | 0.35 | 0.35 |
| 3GD temperature ° C. | 150 | 150 | 150 | 150 | 150 |
| Relaxation ratio % | 0.7 | 0.7 | 0.7 | 0.7 | 0.7 |
| Spinning stability | ⊙ | ⊙ | ⊙ | ⊙ | ○ |
| (Physical properties of conjugate fiber) | | | | | |
| Breaking strength cN/dtex | 2.9 | 2.6 | 2.3 | 2.2 | 2.0 |
| Breaking elongation % | 37 | 38 | 38 | 37 | 38 |
| Stress difference at 10% elongation cN/dtex | 0.40 | 0.25 | 0.25 | 0.23 | 0.20 |
| Maximum stress of dry heat shrinkage stress cN/dtex | 0.15 | 0.13 | 0.12 | 0.10 | 0.08 |
| Starting temperature of manifestation of dry heat shrinkage stress ° C. | 55 | 58 | 58 | 60 | 62 |
| Stretch elongation of manifested crimp Vc % | 0 | 4 | 6 | 9 | 13 |
| Stretch elongation after boiling water treatment $CE_{3.5}$ % | 1 | 11 | 15 | 20 | 25 |
| Number of interlacing | 23 | 24 | 25 | 25 | 25 |
| $T_{max}$ of loss tangent ° C. | 102 | 95 | 92 | 91 | 91 |
| Half-value width of $T_{max}$ of loss tangent ° C. | 34 | 35 | 35 | 35 | 34 |
| Dye exhaustion rate % | 60 | 82 | 85 | 86 | 87 |
| Dyeing quality | ⊙ | ⊙ | ⊙ | ⊙ | ○ |
| Stretch ratio of fabric in the weft direction % | 3 | 10 | 16 | 23 | 28 |
| Stretch recovery of fabric | 60 | 85 | 85 | 90 | 90 |
| False twisting stability | ⊙ | ⊙ | ⊙ | ⊙ | ○ |
| (Physical properties of false-twisted yarn) | | | | | |
| Stretch elongation under loading % | 13 | 65 | 103 | 105 | 108 |
| Elongation recovery rate m/sec | 14 | 25 | 31 | 33 | 34 |
| Dye exhaustion rate % | 65 | 82 | 84 | 83 | 84 |
| Dyeing quality | ⊙ | ⊙ | ⊙ | ⊙ | ○ |
| Stretch ratio of fabric in the weft direction % | 5 | 20 | 22 | 28 | 30 |
| Stretch recovery ratio of fabric % | 62 | 88 | 89 | 93 | 93 |
| Overall estimation | X | ⊙ | ⊙ | ⊙ | ○ |

TABLE 4

| | | C. Ex. 5 | Ex. 12 | Ex. 13 | Ex. 14 | Ex. 15 | C. Ex. 6 |
|---|---|---|---|---|---|---|---|
| High viscosity component | Polymer type | PTT | PTT | PTT | PTT | PTT | PTT |
| | [η] dl/g | 1.26 | 1.26 | 1.26 | 1.26 | 1.26 | 1.26 |
| Low viscosity component | Polymer type | PTT | PTT | PTT | PTT | PTT | PTT |
| | [η] dl/g | 0.92 | 0.92 | 0.92 | 0.92 | 0.92 | 0.92 |
| Viscosity difference dl/g | | 0.34 | 0.34 | 0.34 | 0.34 | 0.34 | 0.34 |
| (Winding conditions) | | | | | | | |
| Spinning speed m/min | | 1000 | 2600 | 2000 | 2000 | 2000 | 2000 |
| Winding speed m/min | | 1500 | 2930 | 2500 | 3000 | 3350 | 4150 |
| Draw ratio | | 1.32 | 1.13 | 1.31 | 1.6 | 1.75 | 2.15 |
| Drawing stress cN/dtex | | 0.2 | 0.25 | 0.3 | 0.45 | 0.2 | 0.2 |
| Heat treatment tension between 2GD–3GD CN/dtex | | 0.06 | 0.09 | 0.11 | 0.35 | 0.06 | 0.06 |
| 3GD temperature ° C. | | 60 | 60 | 150 | 150 | 60 | 60 |
| Relaxation ratio % | | −11.9 | −1.0 | 1.1 | 1.3 | 0 | 0.0 |
| Spinning stability | | X* | ◎ | ◎ | ◎ | ○ | X |
| (Physical properties of conjugate fiber) | | | | | | | |
| Breaking strength cN/dtex | | 1.5 | 1.8 | 2.1 | 2.5 | 2.7 | 3.5 |
| Breaking elongation % | | 120 | 79 | 50 | 33 | 29 | 23 |
| Stress difference at 10% elongation cN/dtex | | 0.40 | 0.30 | 0.25 | 0.26 | 0.25 | 0.43 |
| Maximum stress of dry heat shrinkage stress cN/dtex | | 0.01 | 0.05 | 0.08 | 0.15 | 0.22 | 0.30 |
| Starting temperature of manifestation of dry heat shrinkage stress ° C. | | 81 | 70 | 68 | 52 | 51 | 40 |
| Stretch elongation of manifested crimp Vc % | | 0 | 2 | 3 | 5 | 10 | 28 |
| Stretch elongation after boiling water treatment $CE_{3.5}$ % | | 0 | 2 | 7 | 13 | 15 | 28 |
| Number of interlacing | | 60 | 20 | 40 | 20 | 25 | 10 |
| $T_{max}$ of loss tangent ° C. | | 89 | 90 | 91 | 92 | 95 | 98 |
| Half-value width of $T_{max}$ of loss tangent ° C. | | 35 | 36 | 34 | 34 | 35 | 36 |
| Dye exhaustion rate % | | 90 | 88 | 86 | 84 | 85 | 82 |
| Dyeing quality | | X | ○ | ◎ | ◎ | ◎ | X |
| Stretch ratio of fabric in the weft direction % | | 4 | 8 | 12 | 23 | 28 | 29 |
| Stretch recovery of fabric | | 76 | 80 | 85 | 91 | 92 | 90 |
| False twisting stability | | X | ◎ | ◎ | ◎ | ◎ | X** |
| (Physical properties of false-twisted yarn) | | | | | | | |
| Stretch elongation under loading % | | 66 | 85 | 98 | 101 | 103 | — |
| Elongation recovery rate m/sec | | 24 | 28 | 29 | 30 | 31 | — |
| Dye exhaustion rate % | | 78 | 82 | 83 | 84 | 83 | — |
| Dyeing quality | | X | ○ | ◎ | ◎ | ○ | — |
| Stretch ratio of fabric in the weft direction % | | 6 | 28 | 29 | 30 | 31 | — |
| Stretch recovery ratio of fabric % | | 77 | 84 | 89 | 92 | 93 | — |
| Overall estimation | | X | ○ | ◎ | ◎ | ○ | X |

Note: *Yarn being shaken
**Fluff

TABLE 5

| | | Ex. 16 | Ex. 17 | Ex. 18 | Ex. 19 | Ex. 20 | C. Ex. 7 |
|---|---|---|---|---|---|---|---|
| High viscosity component | Polymer type | PTT | PTT | PTT | PTT | PTT | PTT |
| | [η] dl/g | 1.26 | 1.26 | 1.26 | 1.26 | 1.26 | 1.26 |
| Low viscosity component | Polymer type | PTT | PTT | PTT | PTT | PTT | PTT |
| | [η] dl/g | 0.92 | 0.92 | 0.92 | 0.92 | 0.92 | 0.92 |
| Viscosity difference dl/g | | 0.34 | 0.34 | 0.34 | 0.34 | 0.34 | 0.34 |
| (Winding conditions) | | | | | | | |
| Spinning speed m/min | | 2000 | 2000 | 2000 | 2000 | 2000 | 2000 |
| Winding speed m/min | | 2870 | 2820 | 2870 | 2870 | 2810 | 2820 |
| Draw ratio | | 1.51 | 1.51 | 1.51 | 1.51 | 1.51 | 1.41 |
| Drawing stress cN/dtex | | 0.35 | 0.35 | 0.35 | 0.35 | 0.35 | 0.35 |
| Heat treatment tension between 2GD–3GD CN/dtex | | 0.12 | 0.47 | 0.44 | 0.25 | 0.03 | 0.50 |
| 3GD temperature ° C. | | 150 | 150 | 90 | 200 | 150 | 30° C.* |
| Relaxation ratio % | | 1.6 | −9.1 | 0.7 | 0.7 | 9.0 | 0.0 |
| Spinning stability | | ◎ | ○ | ◎ | ○ | ◎ | X** |
| (Physical properties of conjugate fiber) | | | | | | | |
| Breaking strength cN/dtex | | 2.3 | 2.4 | 2.4 | 2.3 | 2.3 | 2.4 |
| Breaking elongation % | | 38 | 37 | 38 | 37 | 39 | 37 |
| Stress difference at 10% elongation cN/dtex | | 0.24 | 0.23 | 0.25 | 0.23 | 0.25 | 0.35 |
| Maximum stress of dry heat shrinkage stress cN/dtex | | 0.10 | 0.24 | 0.20 | 0.09 | 0.05 | 0.30 |
| Starting temperature of manifestation of dry heat | | 59 | 52 | 55 | 59 | 70 | 45 |

TABLE 5-continued

| | Ex. 16 | Ex. 17 | Ex. 18 | Ex. 19 | Ex. 20 | C. Ex. 7 |
|---|---|---|---|---|---|---|
| shrinkage stress ° C. | | | | | | |
| Stretch elongation of manifested crimp Vc % | 4 | 6 | 8 | 8 | 2 | 29 |
| Stretch elongation after boiling water treatment $CE_{3.5}$ % | 11 | 13 | 14 | 9 | 5 | 15 |
| Number of interlacing | 10 | 20 | 28 | 11 | 10 | 12 |
| $T_{max}$ of loss tangent ° C. | 92 | 92 | 93 | 92 | 92 | 92 |
| Half-value width of $T_{max}$ of loss tangent ° C. | 35 | 34 | 35 | 34 | 34 | 35 |
| Dye exhaustion rate % | 84 | 85 | 85 | 84 | 84 | 83 |
| Dyeing quality | ◎ | ◎ | ◎ | ◎ | ◎ | X |
| Stretch ratio of fabric in the weft direction % | 13 | 16 | 16 | 16 | 7 | + |
| Stretch recovery of fabric | 85 | 85 | 85 | 85 | 80 | |
| False twisting stability | ◎ | ◎ | ◎ | ◎ | ◎ | ◎ |
| (Physical properties of false-twisted yarn) | | | | | | |
| Stretch elongation under loading % | 100 | 104 | 105 | 102 | 90 | — |
| Elongation recovery rate m/sec | 26 | 29 | 29 | 27 | 22 | — |
| Dye exhaustion rate % | 84 | 85 | 84 | 84 | 84 | — |
| Dyeing quality | ◎ | ◎ | ◎ | ○ | ◎ | — |
| Stretch ratio of fabric in the weft direction % | 14 | 17 | 18 | 18 | 8 | — |
| Stretch recovery ratio of fabric % | 89 | 89 | 88 | 88 | 89 | — |
| Overall estimation | ◎ | ○ | ◎ | ○ | ○ | X |

Note: *Room temperature
**Package tightening
+ Incapable of being measured due to an insufficient winding amount

TABLE 6

| | Ex. 21 | Ex. 22 | Ex. 23 | C. Ex. 8 |
|---|---|---|---|---|
| High viscosity component | | | | |
| Type of polymer | PTT | PTT | PTT | PET |
| [η] dl/g | 1.26 | 1.26 | 1.02 | 0.65 |
| High viscosity component | | | | |
| Type of polymer | PBT | PET | PET | PET |
| [η] dl/g | 1.0 | 0.5 | 0.5 | 0.5 |
| Viscosity difference dl/g | 0.26 | 0.76 | 0.52 | 0.15 |
| Spinning stability | ◎ | ◎ | ◎ | ◎ |
| (Physical properties of conjugate fiber) | | | | |
| Breaking strength cN/dtex | 2.4 | 3.2 | 3.4 | 4.1 |
| Breaking elongation % | 41 | 41 | 40 | 28 |
| Stress difference at 10% elongation cN/dtex | 0.23 | 0.25 | 0.28 | 0.33 |
| Maximum stress of dry heat shrinkage stress cN/dtex | 0.09 | 0.10 | 0.10 | 0.26 |
| Starting temperature of manifestation of dry heat shrinkage stress ° C. | 59 | 58 | 58 | 57 |
| Stretch elongation of manifested crimp Vc % | 6 | 4 | 5 | 0 |

TABLE 6-continued

| | Ex. 21 | Ex. 22 | Ex. 23 | C. Ex. 8 |
|---|---|---|---|---|
| Stretch elongation after boiling water treatment $CE_{3.5}$ % | 15 | 12 | 13 | 4 |
| Number of interlacing | 20 | 20 | 21 | 23 |
| $T_{max}$ of loss tangent ° C. | 95 | 133 | 135 | 130 |
| Half-value width of $T_{max}$ of loss tangent ° C. | 35 | 40 | 43 | 23 |
| Dye exhaustion rate % | 84 | 82 | 82 | 70 |
| Dyeing quality | ◎ | ◎ | ○ | ○ |
| Stretch ratio of fabric in the weft direction % | 20 | 17 | 14 | 3 |
| Stretch recovery of fabric | 89 | 82 | 80 | 53 |
| False twisting stability | ◎ | ○ | ○ | ○ |
| (Physical properties of false-twisted yarn) | | | | |
| Stretch elongation under loading % | 15 | 12 | 13 | 5 |
| Elongation recovery rate m/sec | 25 | 26 | 29 | 14 |
| Dye exhaustion rate % | 83 | 82 | 82 | 40 |
| Dyeing quality | ◎ | ◎ | ○ | ○ |
| Stretch ratio of fabric in the weft direction % | 25 | 22 | 19 | 4 |
| Stretch recovery ratio of fabric % | 91 | 85 | 84 | 55 |
| Overall estimation | ◎ | ○ | ○ | X |

TABLE 7

| | C. Ex. 9 | Ex. 24 | Ex. 25 | Ex. 26 | C. Ex. 10 |
|---|---|---|---|---|---|
| High viscosity component | | | | | |
| Type of polymer | PTT | PTT | PTT | PTT | PTT |
| [η] dl/g | 1.26 | 1.26 | 1.26 | 1.26 | 1.26 |
| Low viscosity component | | | | | |
| Type of polymer | PTT | PTT | PTT | PTT | PTT |
| [η] dl/g | 0.92 | 0.92 | 0.92 | 0.92 | 0.92 |
| Viscosity difference dl/g | 0.34 | 0.34 | 0.34 | 0.34 | 0.34 |
| (Winding conditions) | | | | | |
| Spinning speed m/min | 1000 | 1500 | 2500 | 3000 | 3500 |
| Winding speed m/min | 2180 | 2360 | 2800 | 2900 | 4050 |
| Draw ratio | 2.2 | 1.6 | 1.2 | 1.1 | 1.2 |

TABLE 7-continued

| | C. Ex. 9 | Ex. 24 | Ex. 25 | Ex. 26 | C. Ex. 10 |
|---|---|---|---|---|---|
| Relaxation ratio | 0.4 | 1.2 | 0.7 | 5.2 | 2.4 |
| Spinning stability | ○ | ◎ | ◎ | ◎ | X |
| (Physical properties of conjugate fiber) | | | | | |
| Breaking strength cN/dtex | 2.3 | 2.2 | 2 | 2 | 1.8 |
| Breaking elongation % | 54 | 55 | 55 | 54 | 32 |
| Stress difference at 10% elongation cN/dtex | 0.3 | 0.25 | 0.23 | 0.22 | 0.35 |
| Maximum stress of dry heat shrinkage stress cN/dtex | 0.05 | 0.04 | 0.05 | 0.03 | 0.02 |
| Starting temperature of manifestation of dry heat shrinkage stress ° C. | 70 | 71 | 70 | 73 | 75 |
| Stretch elongation of manifested crimp Vc % | 0 | 2 | 3 | 1 | 27 |
| Stretch elongation after boiling water treatment $CE_{3.5}$ % | 1 | 4 | 5 | 5 | 15 |
| Number of interlacing | 60 | 20 | 25 | 10 | 1 |
| $T_{max}$ of loss tangent ° C. | 98 | 95 | 92 | 90 | 101 |
| Half-value width of $T_{max}$ of loss tangent ° C. | 34 | 35 | 35 | 34 | 37 |
| Dye exhaustion rate % | 80 | 83 | 83 | 84 | 80 |
| Dyeing quality | X | ○ | ◎ | ◎ | ◎ |
| Stretch ratio of fabric in the weft direction % | 40 | 41 | 43 | 41 | 40 |
| Stretch recovery of fabric | 88 | 85 | 90 | 91 | 89 |
| False twisting stability | ◎ | ◎ | ◎ | ◎ | X* |
| (Physical properties of false-twisted yarn) | | | | | |
| Stretch elongation under loading % | 67 | 82 | 85 | 86 | 85 |
| Elongation recovery rate m/sec | 20 | 26 | 31 | 32 | 32 |
| Dye exhaustion rate % | 81 | 82 | 82 | 83 | 82 |
| Dyeing quality | X | ○ | ◎ | ◎ | ◎ |
| Stretch ratio of fabric in the weft direction % | 41 | 44 | 47 | 46 | 42 |
| Stretch recovery ratio of fabric % | 89 | 89 | 93 | 94 | 92 |
| Overall estimation | X | ○ | ◎ | ◎ | X |

Note: *Fluff

Industrial Applicability

The PTT-based conjugate fiber of the present invention is excellent in dyeing uniformity and dyeing uniformity, is suited to high speed false twisting, and has at least one effect of excelling at high stretchability, dyeing quality and ease of dyeing. Accordingly, when the conjugate fiber is used for clothing such as sportswear, the clothing shows an excellent effect of instantaneously adapting to a local and instantaneous motional displacement.

Furthermore, according to the present invention, a PTT-based conjugate fiber can be industrially stably produced by a direct spin-draw process. Moreover, yarn breakage that has heretofore caused a problem during high speed false twisting is overcome, and an excellent false-twisted yarn can be produced.

What is claimed is:

1. A conjugate fiber characterized in that the fiber is composed of single filaments which are combined with two polyester components in a side-by-side manner or an eccentric sheath-core manner, that at least one of the two polyester components forming the single filaments is a poly (trimethylene terephthalate), and that the fiber satisfies the following conditions (1) to (3):

(1) the stretch elongation of crimp manifested prior to boiling water treatment is 20% or less;

(2) the breaking elongation is from 25 to 100%; and (3) the maximum stress value of a dry heat shrinkage stress is from 0.01 to 0.24 cN/dtex.

2. The conjugate fiber according to claim 1, wherein the starting temperature of manifestation of a dry heat shrinkage stress is from 50 to 80° C.

3. The conjugate fiber according to claim 1, wherein the breaking elongation is from 45 to 100%.

4. The conjugate fiber according to claim 1, wherein the stretch elongation of crimp manifested prior to the boiling water treatment is 10% or less.

5. The conjugate fiber according to claim 1, wherein the stretch elongation after boiling water treatment under a load of $3.5\times10^{-3}$ cN/dtex ($CE_{3.5}$) is from 12 to 30%.

6. The conjugate fiber according to claim 1, wherein the maximum stress value of a dry heat shrinkage stress of the conjugate fiber is from 0.05 to 0.24 cN/dtex, and the breaking elongation is from 30 to 55%.

7. The conjugate fiber according to claim 1, wherein the maximum stress value of a dry heat shrinkage stress of the conjugate fiber is from 0.02 to 0.15 cN/dtex.

8. The conjugate fiber according to claim 1, wherein a stress value at 10% elongation in an elongation-stress measurement of the conjugate fiber shows a difference between a maximum value and a minimum value along a yarn length direction of 0.30 cN/dtex or less.

9. The conjugate fiber according to claim 1, wherein a number of interlacing is from 2 to 50/m.

10. The conjugate fiber according to claim 1, wherein the two polyester components forming the single filaments are both poly(trimethylene terephthalate).

11. The conjugate fiber according to claim 1, wherein the other one of the two polyester components forming the single filaments is a poly(butylene terephthalate) or a poly (ethylene terephthalate).

12. The conjugate fiber according to claim 1, wherein the other one of the two polyester components forming the single filaments is a poly(trimethylene terephthalate) or a poly(butylene terephthalate), and the maximum temperature $T_{max}$ of a loss tangent obtained by the dynamic viscoelasticity measurement is from 80 to 98° C.

13. The conjugate fiber according to claim 1, wherein the other one of the two polyester components forming the single filaments is a poly(ethylene terephthalate), and the half-value width of the maximum temperature $T_{max}$ of a loss tangent obtained by the dynamic viscoelasticity measurement is from 25 to 50° C.

14. The conjugate fiber according to claim 1, wherein the fiber is produced by a direct spin-draw process, and the fiber is wound in a package shape.

* * * * *